US010633950B2

(12) United States Patent
Barbee

(10) Patent No.: US 10,633,950 B2
(45) **Date of Patent: *Apr. 28, 2020**

(54) METHOD AND APPARATUS FOR DROPPING A PUMP DOWN PLUG OR BALL

(71) Applicant: GULFSTREAM SERVICES, INC., Houma, LA (US)

(72) Inventor: Phil Barbee, Gretna, LA (US)

(73) Assignee: GULFSTREAM SERVICES, INC., Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/225,945

(22) Filed: Dec. 19, 2018

(65) Prior Publication Data

US 2019/0195045 A1 Jun. 27, 2019

Related U.S. Application Data

(63) Continuation of application No. 15/846,203, filed on Jan. 8, 2018, now Pat. No. 10,196,876, which is a continuation of application No. 15/205,881, filed on Jul. 8, 2016, now Pat. No. 9,863,212, which is a continuation of application No. 14/606,526, filed on (Continued)

(51) Int. Cl.

| | |
|---|---|
| ***E21B 33/05*** | (2006.01) |
| ***E21B 33/16*** | (2006.01) |
| ***E21B 34/02*** | (2006.01) |

(52) U.S. Cl.

CPC ..... *E21B 33/16* (2013.01); *E21B 33/05* (2013.01); *E21B 34/02* (2013.01)

(58) Field of Classification Search

CPC ..... E21B 33/05; E21B 33/16; E21B 33/068; E21B 34/14; E21B 21/10; E21B 2034/002

See application file for complete search history.

(56) References Cited

U.S. PATENT DOCUMENTS

| | | | |
|---|---|---|---|
| 3,828,852 | A | 8/1974 | Delano |
| 4,345,651 | A | 8/1982 | Akkerman et al. |

(Continued)

FOREIGN PATENT DOCUMENTS

| | | |
|---|---|---|
| EP | 0500165 A1 | 8/1992 |
| EP | 1496193 | 1/2005 |

OTHER PUBLICATIONS

Supplementary Partial European Search Report for EP App. No. 10815884.1, dated May 11, 2017.

(Continued)

*Primary Examiner* — Daniel P Stephenson

(74) *Attorney, Agent, or Firm* — Garvey, Smith & Nehrbass, Patent Attorneys, L.L.C.; Charles C. Garvey, Jr.; Julie R. Chauvin

(57) ABSTRACT

An improved method and apparatus for dropping a ball, plug or dart during oil and gas well operations (e.g., cementing operations) employs a specially configured valving member with curved and flat portions that alternatively direct fluid flow through a bore or opening in the valving member via an inner channel or around the periphery of the valving member in an outer channel. In one embodiment, the ball(s), dart(s) or plug(s) are contained in a sliding sleeve that shifts position responsive to valve rotation. An optional indicator indicates to a user or operator that a ball or plug has passed a selected one of the valving members.

20 Claims, 29 Drawing Sheets

Related U.S. Application Data

Jan. 27, 2015, now Pat. No. 9,410,395, which is a continuation of application No. 14/149,243, filed on Jan. 7, 2014, now Pat. No. 8,939,209, which is a continuation of application No. 13/603,144, filed on Sep. 4, 2012, now Pat. No. 8,622,130, which is a continuation of application No. 12/548,577, filed on Aug. 27, 2009, now Pat. No. 8,256,515.

(56) References Cited

U.S. PATENT DOCUMENTS 4,427,065 A 1/1984 Watson
4,624,312 A * 11/1986 McMullin ..... E21B 33/05 166/153
4,671,353 A 6/1987 Darning
4,674,573 A 6/1987 Bode
4,722,389 A 2/1988 Arnold
4,782,894 A 11/1988 LaFleur
4,854,383 A 8/1989 Arnold et al.
4,995,457 A 2/1991 Baldridge
5,095,988 A 3/1992 Bode
5,236,035 A 8/1993 Brisco et al.
5,293,933 A 3/1994 Brisco
5,435,390 A 7/1995 Baugh et al.
5,443,122 A 8/1995 Brisco
5,758,726 A 6/1998 Streich et al.
5,833,002 A 11/1998 Holcombe
5,856,790 A 1/1999 Baugh et al.
5,890,537 A 4/1999 Lavaure et al.
5,950,724 A 9/1999 Giebeler
5,960,881 A 10/1999 Allamon et al.
6,142,226 A 11/2000 Vick
6,182,752 B1 2/2001 Smith, Jr. et al.
6,390,200 B1 5/2002 Allamon et al.
6,575,238 B1 6/2003 Yokley
6,672,384 B2 * 1/2004 Pedersen ..... E21B 33/05 166/177.4
6,715,541 B2 4/2004 Pedersen et al.
6,904,970 B2 6/2005 Simson
7,055,611 B2 6/2006 Pedersen et al.
7,066,249 B2 6/2006 Simson
7,607,481 B2 * 10/2009 Barbee ..... E21B 33/05 166/177.4
7,841,410 B2 * 11/2010 Barbee ..... E21B 33/05 166/177.4
7,918,278 B2 * 4/2011 Barbee ..... E21B 33/05 166/177.4
7,980,313 B2 * 7/2011 Barbee, Jr. ..... E21B 33/16 166/325
8,215,396 B2 * 7/2012 Barbee ..... E21B 33/05 166/177.4
8,256,515 B2 * 9/2012 Barbee ..... E21B 33/05 166/291
8,573,301 B2 * 11/2013 Barbee ..... E21B 33/05 166/177.4
8,622,130 B2 * 1/2014 Barbee ..... E21B 33/05 166/291
8,651,174 B2 * 2/2014 Barbee ..... E21B 33/05 166/70
8,939,209 B2 * 1/2015 Barbee ..... E21B 33/05 166/291
8,997,850 B2 * 4/2015 Barbee ..... E21B 33/05 166/70
9,341,040 B2 * 5/2016 Barbee ..... E21B 33/05
9,410,395 B2 * 8/2016 Barbee ..... E21B 33/05
9,598,925 B1 * 3/2017 Barbee, Jr. ..... E21B 33/16
9,863,212 B2 * 1/2018 Barbee ..... E21B 33/05
10,196,876 B2 * 2/2019 Barbee ..... E21B 33/05
2003/0141052 A1 7/2003 Pedersen et al.
2004/0055741 A1 3/2004 Pedersen et al.
2008/0283244 A1 11/2008 Barbee
2008/0283251 A1 11/2008 Barbee
2017/0037699 A1 * 2/2017 Barbee ..... E21B 33/05

OTHER PUBLICATIONS

PCT Notification of Transmittal of the International Search Report and the Written Opinion of the International Searching Authority for International App. No. PCT/US2010/046924, dated Apr. 21, 2011.
European Patent Office Communication pursuant to Article 94(3) EPC for EP App. No. 10815884.1, dated May 11, 2018.

* cited by examiner

METHOD AND APPARATUS FOR DROPPING A PUMP DOWN PLUG OR BALL

CROSS-REFERENCE TO RELATED APPLICATIONS

This is a continuation of U.S. patent application Ser. No. 15/864,203 (issued as U.S. Pat. No. 10,196,876 on 5 Feb. 2019), which is a continuation of U.S. patent application Ser. No. 15/205,881 (issued as U.S. Pat. No. 9,863,212 on 9 Jan. 2018), which is a continuation of U.S. patent application Ser. No. 14/606,526 (issued as U.S. Pat. No. 9,410,395 on 9 Aug. 2016), which is a continuation of U.S. patent application Ser. No. 14/149,243 (issued as U.S. Pat. No. 8,939,209 on 27 Jan. 2015), which is a continuation of U.S. patent application Ser. No. 13/603,144, filed 4 Sep. 2012 (issued as U.S. Pat. No. 8,622,130 on 7 Jan. 2014), which was a continuation of U.S. patent application Ser. No. 12/548,577, filed 27 Aug. 2009 (issued as U.S. Pat. No. 8,256,515 on 4 Sep. 2012), which are hereby incorporated herein by reference.

Priority of U.S. patent application Ser. No. 13/603,144, filed 4 Sep. 2012 and U.S. patent application Ser. No. 12/548,577, filed 27 Aug. 2009, is hereby claimed.

International Application No. PCT/US2010/046924, filed 27 Aug. 2010 (published as Serial No. WO2011/031541 on 17 Mar. 2011), is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus that is of particular utility in cementing operations associated with oil and gas well exploration and production. More specifically the present invention provides an improvement to cementing operations and related operations employing a plug or ball dropping head and wherein plugs can be employed to pump cement into larger diameter casing.

2. General Background of the Invention

Patents have issued that relate generally to the concept of using a plug, dart or a ball that is dispensed or dropped into the well or "down hole" during oil and gas well drilling and production operations, especially when conducting cementing operations. The following possibly relevant patents are incorporated herein by reference. The patents are listed numerically. The order of such listing does not have any significance.

TABLE

| Pat. No. | TITLE | ISSUE DATE |
|---|---|---|
| 3,828,852 | Apparatus for Cementing Well Bore Casing | Aug. 13, 1974 |
| 4,427,065 | Cementing Plug Container and Method of Use Thereof | Jan. 24, 1984 |

TABLE-continued

| Pat. No. | TITLE | ISSUE DATE |
|---|---|---|
| 4,624,312 | Remote Cementing Plug Launching System | Nov. 25, 1986 |
| 4,671,353 | Apparatus for Releasing a Cementing Plug | 4,671,353 |
| 4,722,389 | Well Bore Servicing Arrangement | Feb. 2, 1988 |
| 4,782,894 | Cementing Plug Container with Remote Control System | Nov. 8, 1988 |
| 4,854,383 | Manifold Arrangement for use with a Top Drive Power Unit | Aug. 8, 1989 |
| 4,995,457 | Lift-Through Head and Swivel | Feb. 26, 1991 |
| 5,095,988 | Plug Injection Method and Apparatus | Mar. 17, 1992 |
| 5,236,035 | Swivel Cementing Head with Manifold Assembly | Aug. 17, 1993 |
| 5,293,933 | Swivel Cementing Head with Manifold Assembly Having Remove Control Valves and Plug Release Plungers | Mar. 15, 1994 |
| 5,435,390 | Remote Control for a Plug-Dropping Head | Jul. 25, 1995 |
| 5,758,726 | Ball Drop Head With Rotating Rings | Jun. 2, 1998 |
| 5,833,002 | Remote Control Plug-Dropping Head | Nov. 10, 1998 |
| 5,856,790 | Remote Control for a Plug-Dropping Head | Jan. 5, 1999 |
| 5,960,881 | Downhole Surge Pressure Reduction System and Method of Use | Oct. 5, 1999 |
| 6,142,226 | Hydraulic Setting Tool | Nov. 7, 2000 |
| 6,182,752 | Multi-Port Cementing Head | Feb. 6, 2001 |
| 6,390,200 | Drop Ball Sub and System of Use | May 21, 2002 |
| 6,575,238 | Ball and Plug Dropping Head | Jun. 10, 2003 |
| 6,672,384 | Plug-Dropping Container for Releasing a Plug Into a Wellbore | Jan. 6, 2004 |
| 6,904,970 | Cementing Manifold Assembly | Jun. 14, 2005 |
| 7,066,249 | Plug-Dropping Container for Releasing a Plug into a Wellbore | Jan. 6, 2004 |
| 8,256,515 | Method and Apparatus for Dropping a Pump Down Plug or Ball | Sep. 4, 2012 |

BRIEF SUMMARY OF THE INVENTION

The present invention provides an improved method and apparatus for use in cementing and like operations, employing a plug or ball dropping head of improved configuration. In one embodiment, an interlocking dart and plug arrangement enables pumping of cement into larger diameter casing.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 9:
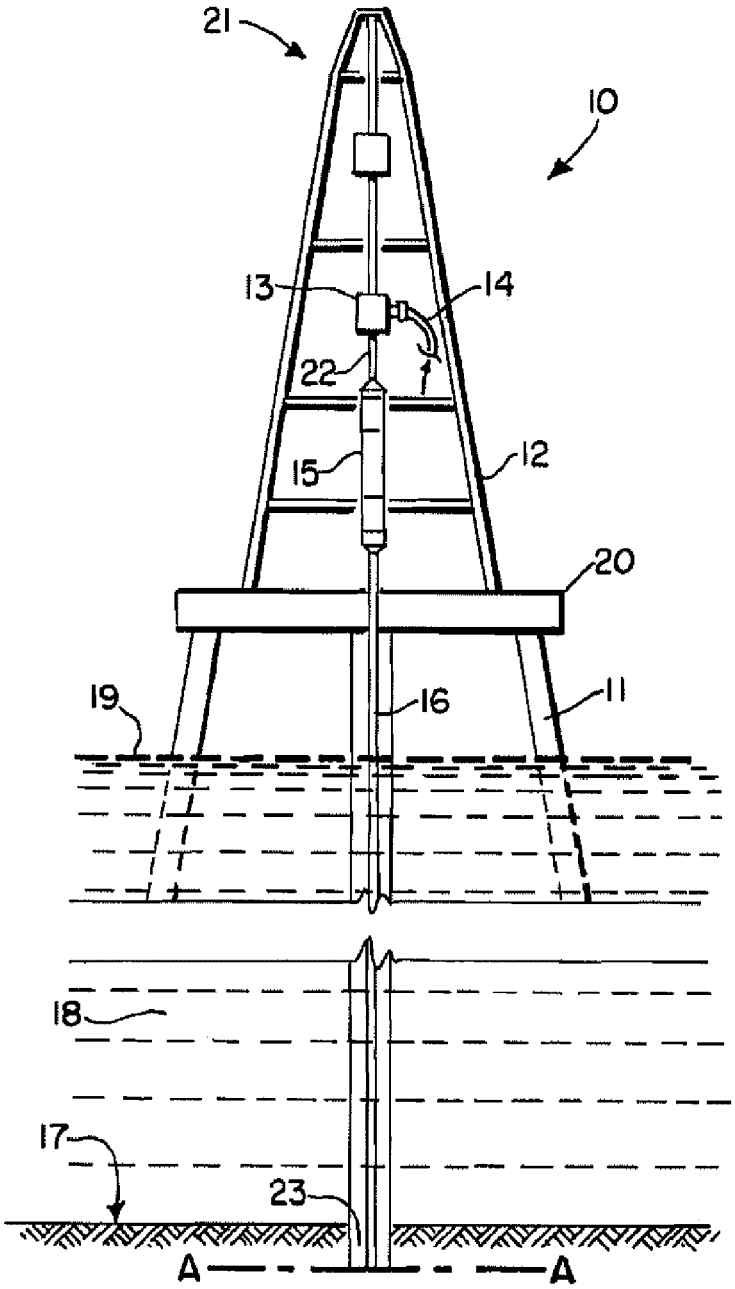
FIG. 9 is an elevation view of the preferred embodiment of the apparatus of the present invention and illustrating the method of the present invention.

FIG. 9 shows generally an oil well drilling structure 10 that can provide a platform 11 such as a marine platform as shown. Such platforms 11 are well known. Platform 11 supports a derrick 12 that can be equipped with a lifting device 21 that supports a top drive unit 13. Such a derrick 12 and top drive unit 13 are well known. A top drive unit 13 can be seen for example in U.S. Pat. Nos. 4,854,383 and 4,722,389 which are incorporated herein by reference.

A flow line 14 can be used for providing a selected fluid such as a fluidized cement or fluidized setable material to be pumped into the well during operations which are known in the industry and are sometimes referred to as cementing operations. Such cementing operations are discussed for example in prior U.S. Pat. Nos. 3,828,852; 4,427,065; 4,671,353; 4,782,894; 4,995,457; 5,236,035; 5,293,933; and 6,182,752, each of which is incorporated herein by reference. A tubular member 22 can be used to support plug dropping head 15 at a position below top drive unit 13 as shown in FIG. 9. String 16 is attached to the lower end portion of plug dropping head 15.

In FIG. 9, the platform 11 can be any oil and gas well drilling platform 11 such as a marine platform shown in a body of water 18 that provides a seabed or mud line 17 and water surface 19. Such a platform 11 provides a platform deck 20 that affords space for well personnel to operate and for the storage of equipment and supplies that are needed for the well drilling operation.

Figure 10:
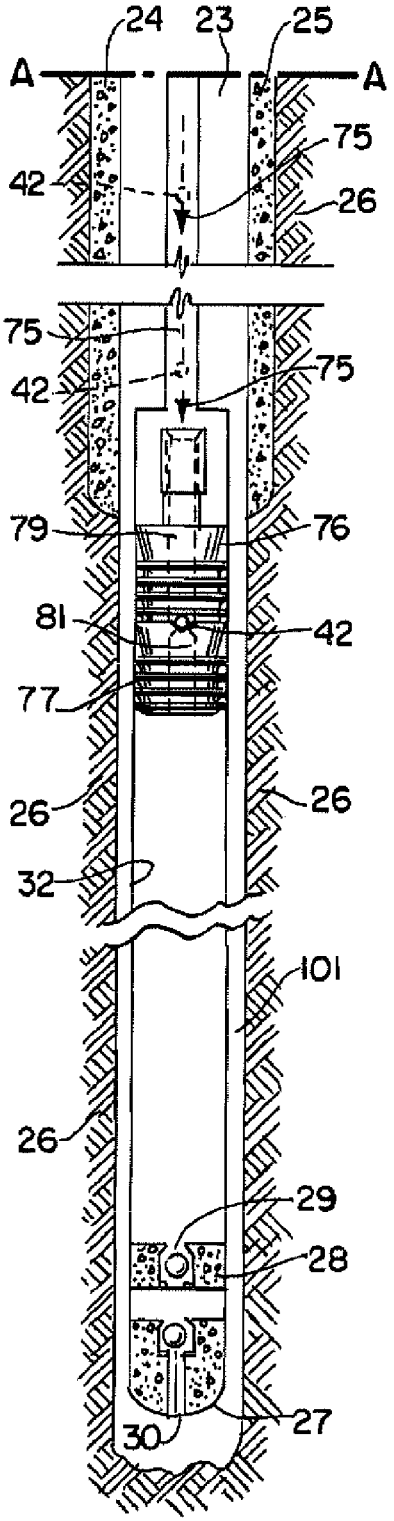
FIG. 10 is a sectional elevation view illustrating part of the method of the present invention and wherein line A-A of FIG. 10 matches line A-A of FIG. 9.
Figure 11:
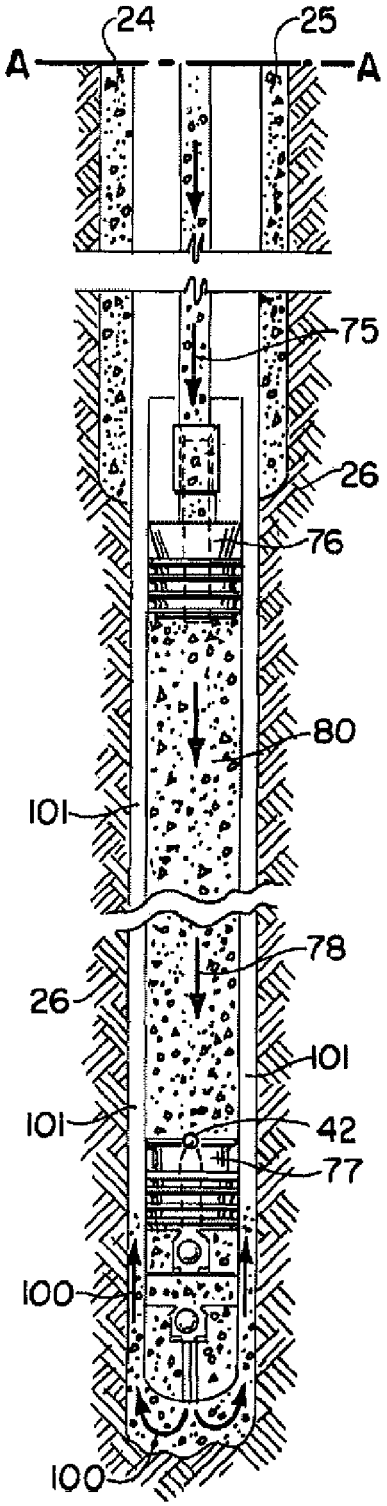
FIG. 11 is a sectional elevation view illustrating part of the method of the present invention and wherein line A-A of FIG. 11 matches line A-A of FIG. 9.

A well bore 23 extends below mud line 17. In FIGS. 10 and 11, the well bore 23 can be surrounded with a surface casing 24. The surface casing 24 can be surrounded with cement/concrete 25 that is positioned in between a surrounding formation 26 and the surface casing 24. Similarly, a liner or production casing 32 extends below surface casing 24. The production casing 32 has a lower end portion that can be fitted with a casing shoe 27 and float valve 28 as shown in FIGS. 10-16. Casing shoe 27 has passageway 30. Float valve 28 has passageway 29.

Figure 1A:
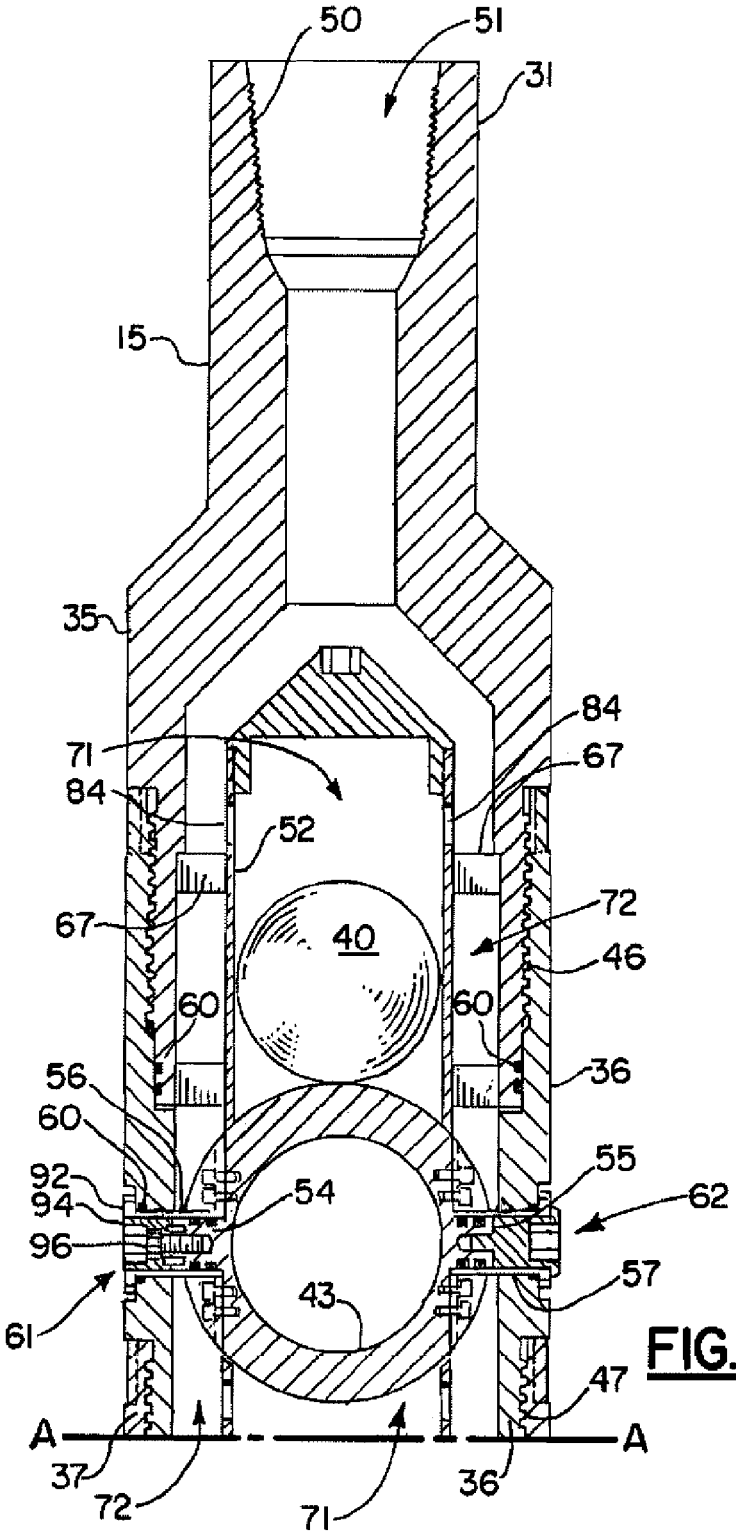
FIGS. 1A, 1B, 1C are partial sectional elevation views of the preferred embodiment of the apparatus of the present invention wherein line A-A of FIG. 1A matches line A-A of FIG. 1B, and line B-B of FIG. 1B matches line B-B of FIG. 1C.
Figure 1B:
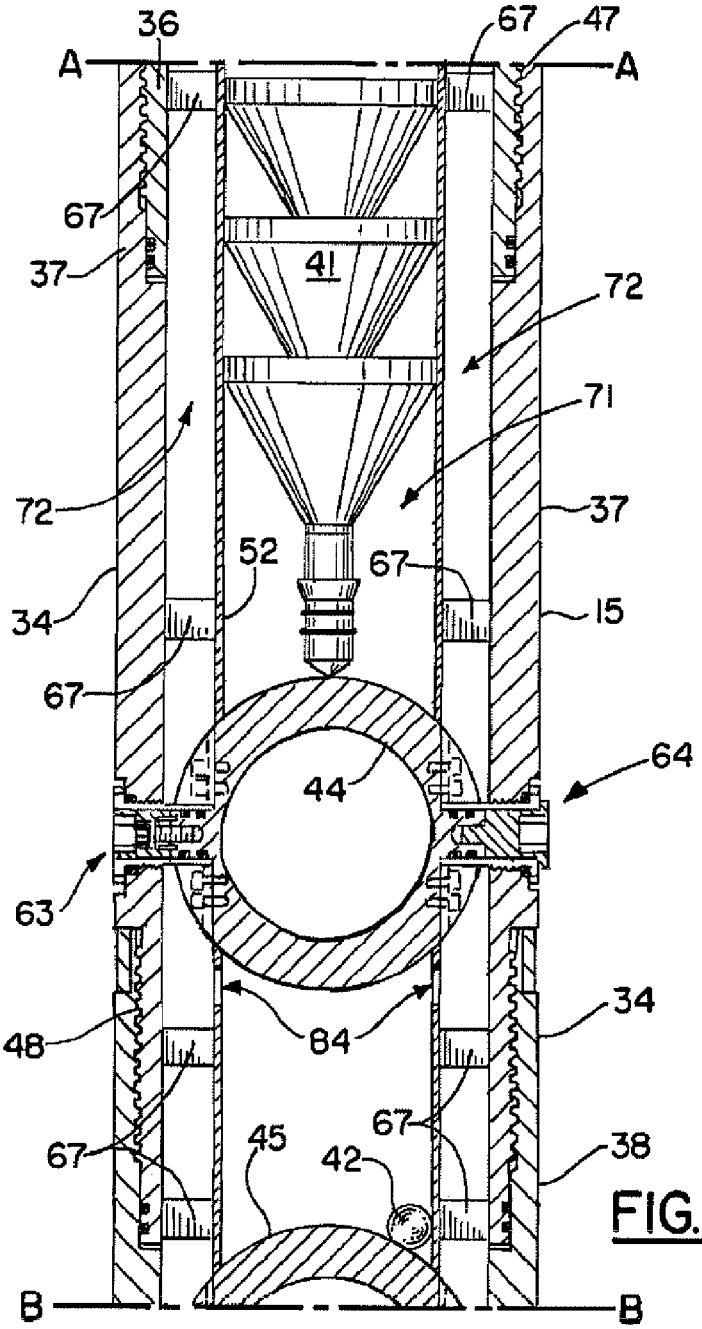
Figure 1C:
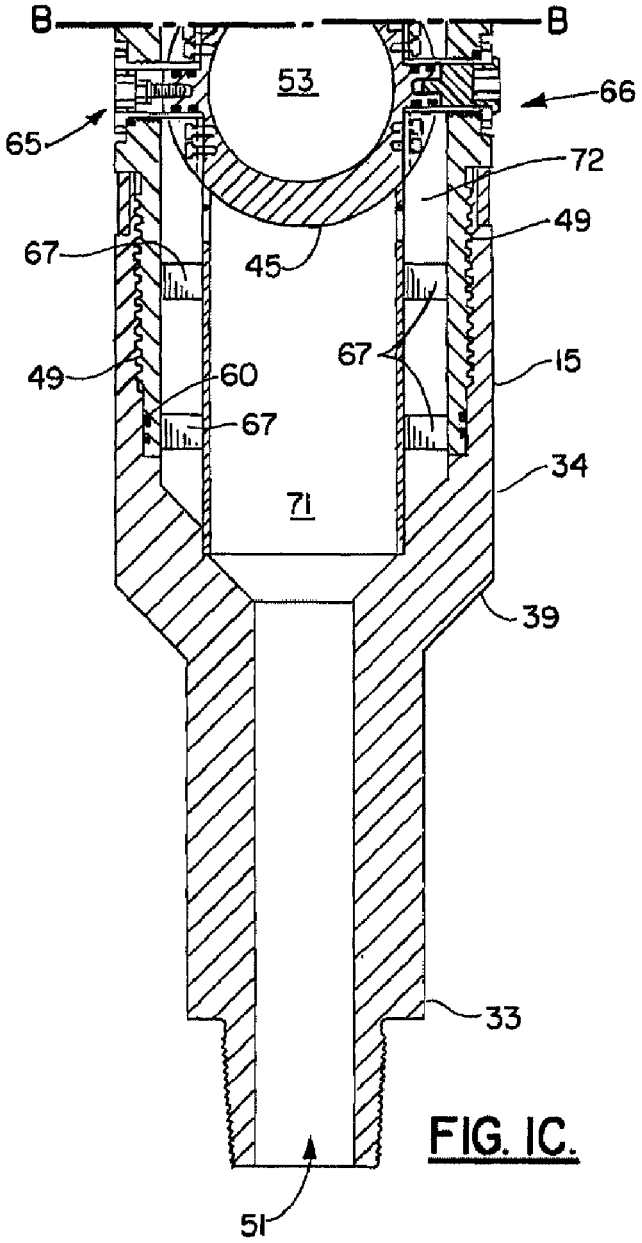
Figure 2:
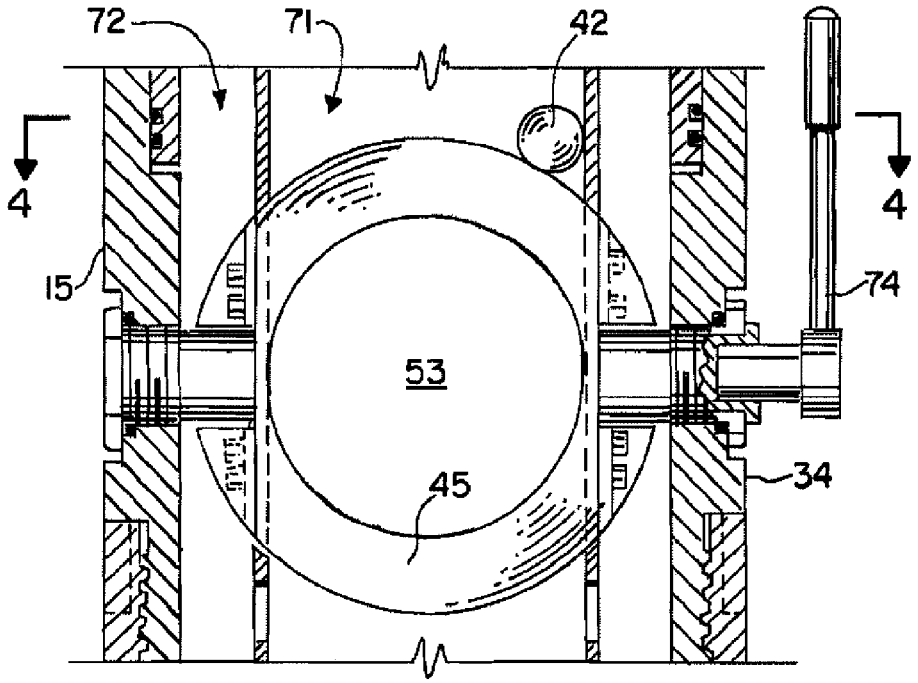
FIG. 2 is a partial, sectional, elevation view of the preferred embodiment of the apparatus of the present invention.

The present invention provides an improved method and apparatus for dropping balls, plugs, darts or the like as a part of a cementing operation. Such cementing operations are in general known and are employed for example when installing a liner such as liner 32. In the drawings, arrows 75 indicate generally the flow path of fluid (e.g. cement, fluidized material or the like) through the tool body 34. In that regard, the present invention provides an improved ball or plug or dart dropping head 15 that is shown in FIGS. 1-8, 10-17 and 18-33. In FIGS. 1A, 1B, 1C and 2-8, ball/plug dropping head 15 has an upper end portion 31 and a lower end portion 33. Ball/plug dropping head 15 provides a tool body 34 that can be of multiple sections that are connected together, such as with threaded connections. In FIGS. 1A-1C, the tool body 34 includes sections 35, 36, 37, 38, 39. The section 35 is an upper section. The section 39 is a lower section.

Ball/plug dropping head 15 can be pre-loaded with a number of different items to be dropped as part of a cementing operation. For example, in FIGS. 1A, 1B, 1C there are a number of items that are contained in ball/plug dropping head 15. These include an upper, larger diameter ball dart 40, 41 and smaller diameter ball 42. In FIGS. 18-26, an alternate embodiment is shown which enables very small diameter balls, sometimes referred to as "frac-balls" 102 (which can have a diameter of between about ½ and ⅝ inches) to be dispensed into the well below toll body 34.

The tool body 34 supports a plurality of valving members at opposed openings 90. The valving members can include first valving member 43 which is an upper valving member. The valving members can include a second valving member 44 which is in between the first valving member 43 and a lower or third valving member 45. Valving member 43 attaches to tool body 34 at upper opening positions 61, 62. Valving member 44 attaches to tool body 34 at middle opening positions 63, 64. Valving member 45 attaches to tool body 43 at lower opening positions 65, 66.

Threaded connections 46, 47, 48, 49 can be used for connecting the various body sections 35, 36, 37, 38, 39 together end to end as shown in FIGS. 1A, 1B, 1C. Tool body 34 upper end 31 is provided with an internally threaded portion 50 for forming a connection with tubular member 22 that depends from top drive unit 13 as shown in FIG. 9. A flow bore 51 extends between upper end 31 and lower end 33 of tool body 34.

Sleeve sections 52 are secured to tool body 34 within bore 15 as shown in FIGS. 1A, 1B, 1C. Sleeves 52 can be generally centered within bore 51 as shown in FIGS. 1A, 1B, 1C using spacers 67 that extend along radial lines from the sections 35-39.

Each valving member 43, 44, 45 is movable between open and closed positions. In FIGS. 1A, 1B, 1C each of the valving members 43, 44, 45 is in a closed position. In that closed position, each valving member 43, 44, 45 prevents downward movement of a plug, ball 40, 42, or dart 41 as shown. In FIG. 1A, the closed position of valving member 43 prevents downward movement of larger diameter ball 40. Similarly, in FIG. 1B, a closed position of valving member 44 prevents a downward movement of dart 41. In FIG. 1B, a closed position of valving member 45 prevents a downward movement of smaller diameter ball 42. In each instance, the ball, dart or plug rests upon the outer curved surface 68 of valving member 43, 44 or 45 as shown in the drawings.

Figure 3:
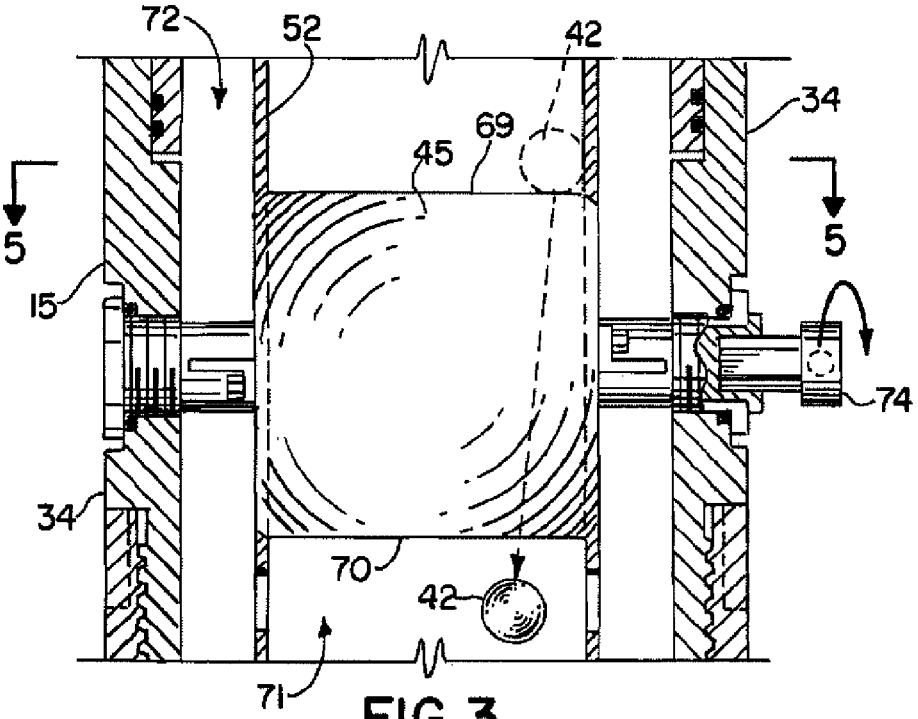
FIG. 3 is a partial, sectional, elevation view of the preferred embodiment of the apparatus of the present invention.
Figure 4:
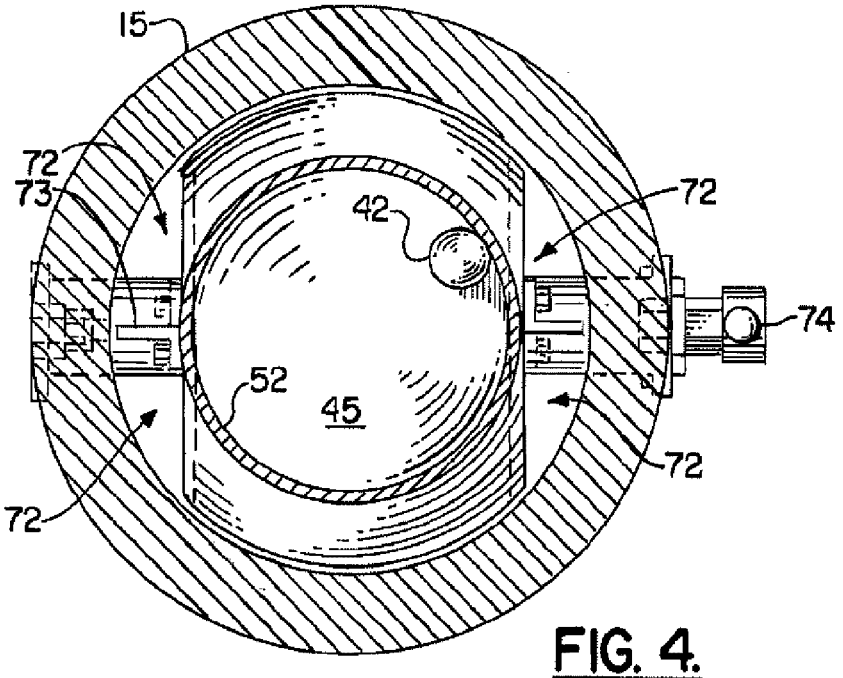
FIG. 4 is a sectional view taken long lines 4-4 of FIG. 2.
Figure 5:
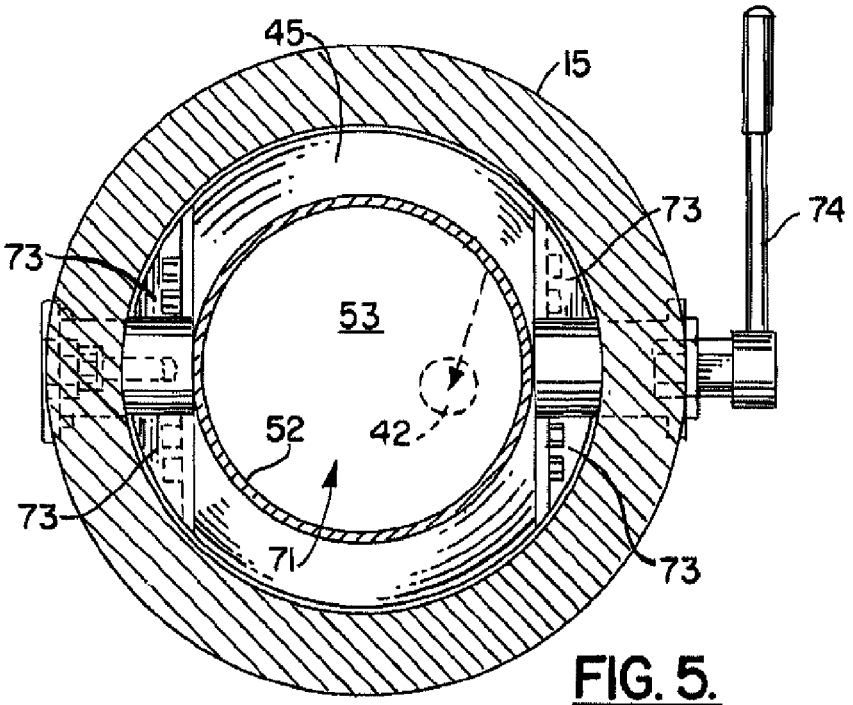
FIG. 5 is a sectional view taken along lines 5-5 of FIG. 3.
Figure 6:
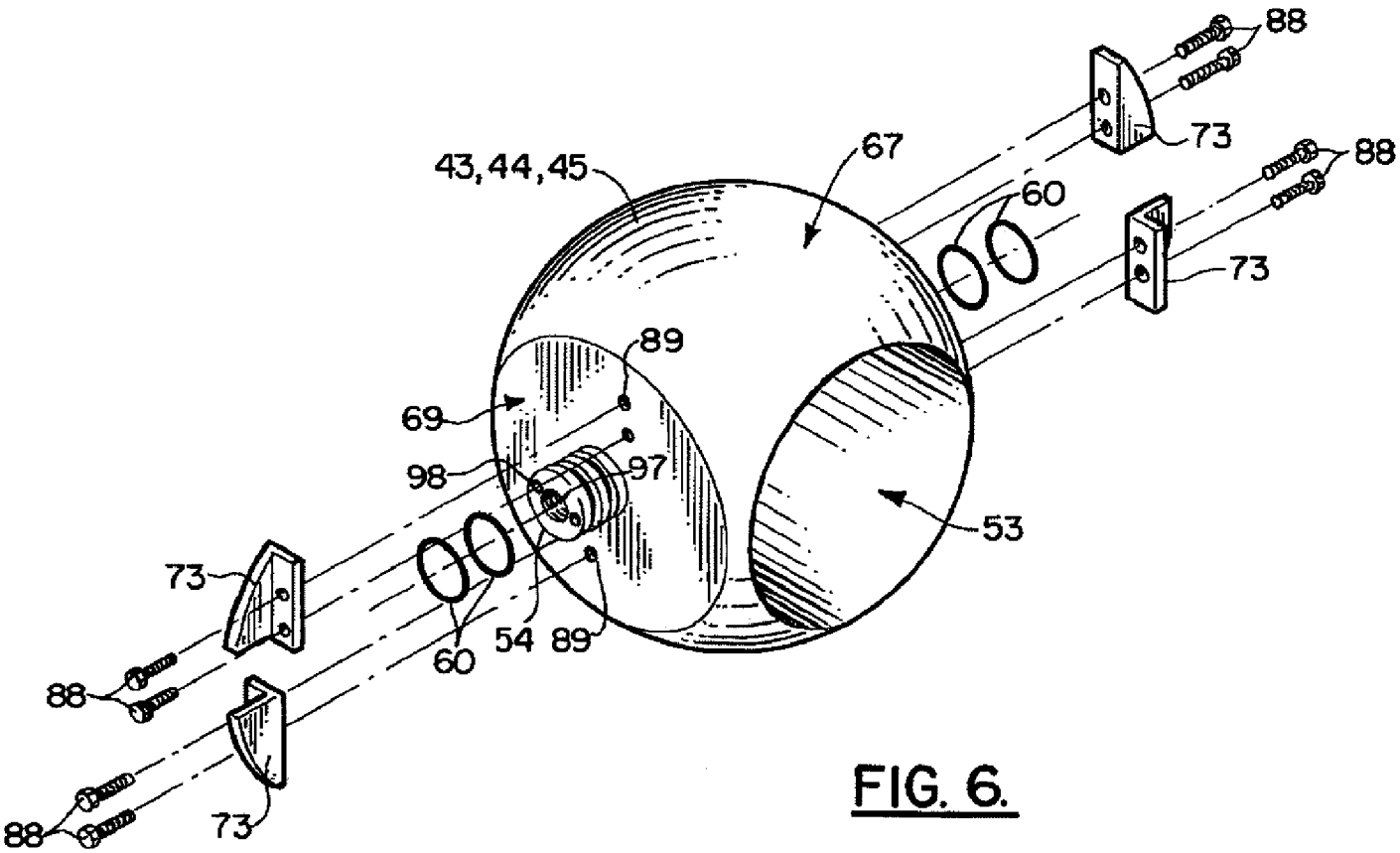
FIG. 6 is a partial perspective view of the preferred embodiment of the apparatus of the present invention.
Figure 17:
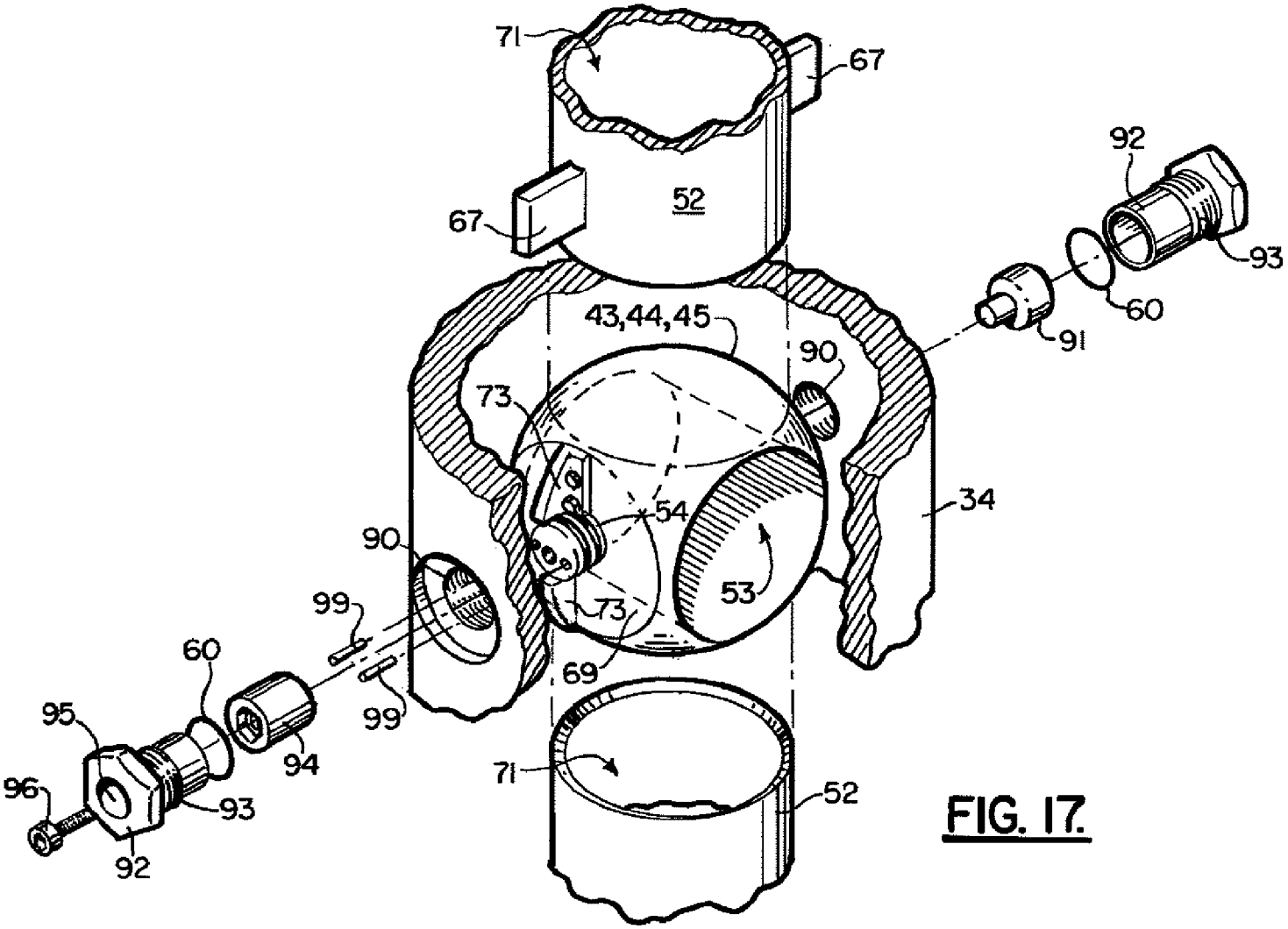
FIG. 17 is a partial perspective view of the preferred embodiment of the apparatus of the present invention.
Figure 18:
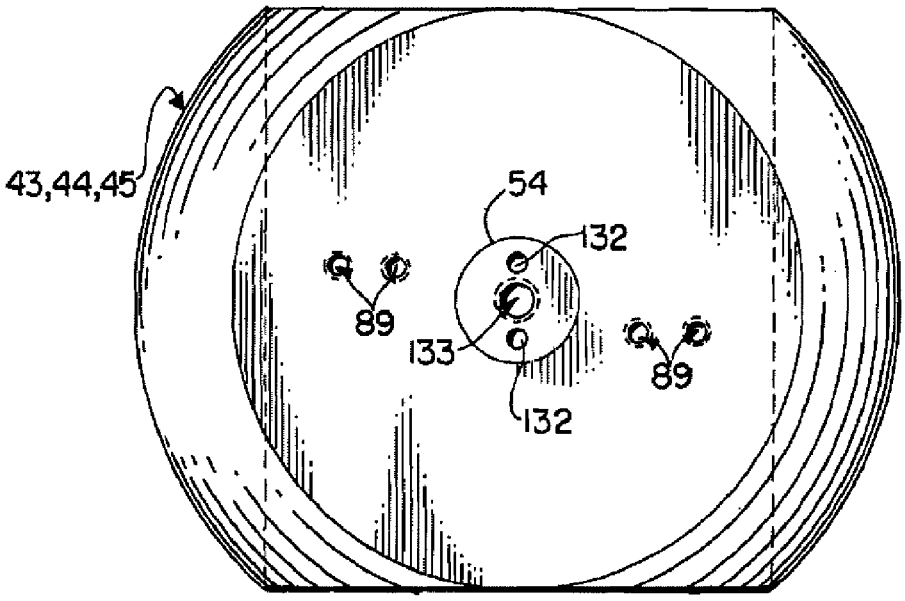
FIG. 18 is a partial view of the preferred embodiment of the apparatus of the present invention and showing a ball valving member.

Each valving member 43, 44, 45 provides a pair of opposed generally flat surfaces 69, 70 (see FIGS. 3, 6, 17). FIG. 17 shows in more detail the connection that is formed between each of the valving members 43, 44, 45 and the tool body 34. The tool body 34 provides opposed openings 90 that are receptive the generally cylindrically shaped valve stems 54, 55 that are provided on the flat sections or flat surfaces 69, 70 of each valving member 43, 44, 45. For example, in FIGS. 6 and 17, the flat surface 69 provides valve stem 54. Openings 90 are receptive of the parts shown in exploded view in FIG. 17 that enable a connection to be formed between the valving member 43, 44 or 45 and the tool body 34. For the stem 55, fastener 91 engages an internally threaded opening of stem 55. Bushing 92 is positioned within opening 90 and the outer surface of stem 55 registers within the central bore 95 of bushing 92. Bushing 92 is externally threaded at 93 for engaging a correspondingly internally threaded portion of tool body 34 at opening 90. O-rings 60 can be used to interface between stem 55 and bushing 92. A slightly different configuration is provided for attaching stem 54 to tool body 34. Sleeve 94 occupies a position that surrounds stem 54. Sleeve 54 fits inside of bore 95 of bushing 92. The externally threaded portion 93 of bushing 92 engages correspondingly shaped threads of opening 90. Pins 99 form a connection between the stem 54 at openings 98 and the sleeve 94. Fastener 96 forms a connection between bushing 92 and an internally threaded opening 97 of stem 54. As assembled, this configuration can be seen in FIG. 1A for example. The flat surfaces 69, 70 enable fluid to flow in bore 51 in a position radially outwardly or externally of sleeve or sleeve section 52 by passing between the tool body sections 35, 36, 37, 38, 39 and sleeve 52. Thus, bore 51 is divided into two flow channels. These two flow channels 71, 72 include a central flow channel 71 within sleeves 52 that is generally cylindrically shaped and that aligns generally with the channel 53 of each valving member 43, 44, 45. The second flow channel is an annular outer flow channel 72 that is positioned in between a sleeve 52 and the tool body sections 35, 36, 37, 38, 39. The channels 71, 72 can be concentric. The outer channel 72 is open when the valving members 43, 44, 45 are in the closed positions of FIGS. 1A, 1B and 1C, wherein central flow channel 71 is closed. When the valving members 43, 44, 45 are rotated to a closed position, fins 73 become transversely positioned with respect to the flow path of fluid flowing in channel 72 thus closing outer flow channel 72 (see FIG. 5). This occurs when a valving member 43, 44, 45 is opened for releasing a ball 40 or 42 or for releasing dart 41. FIG. 4 illustrates a closed position (FIG. 4) of the valving member 45 just before releasing smaller diameter ball 42. Fins 73 are generally aligned with bore 15 and with flow channels 71, 72 when flow in channel 72 is desired (FIG. 4). In FIG. 4, valving member 45 is closed and outer flow channel 72 is open.

Figure 7:
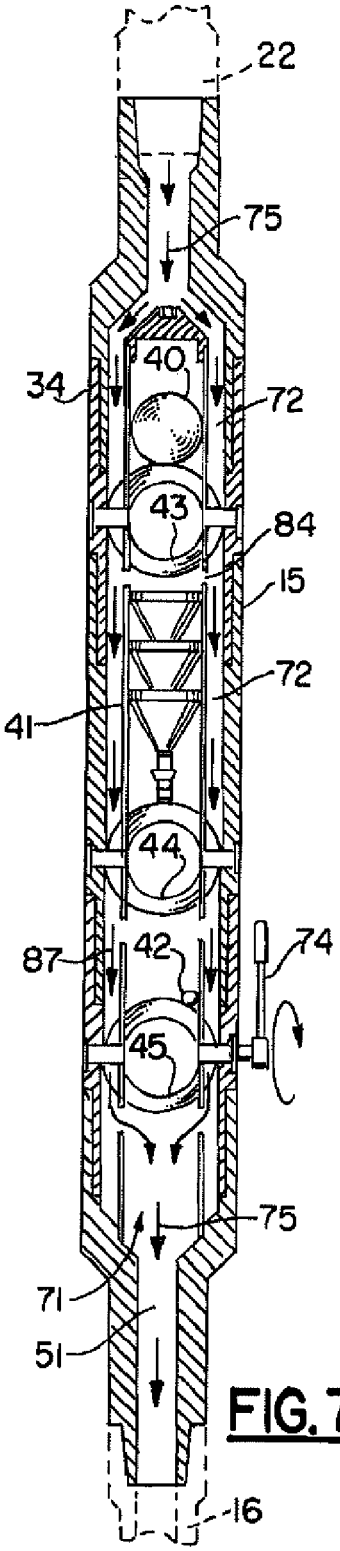
FIG. 7 is a sectional elevation view of the preferred embodiment of the apparatus of the present invention and illustrating a method step of the present invention.
Figure 8:
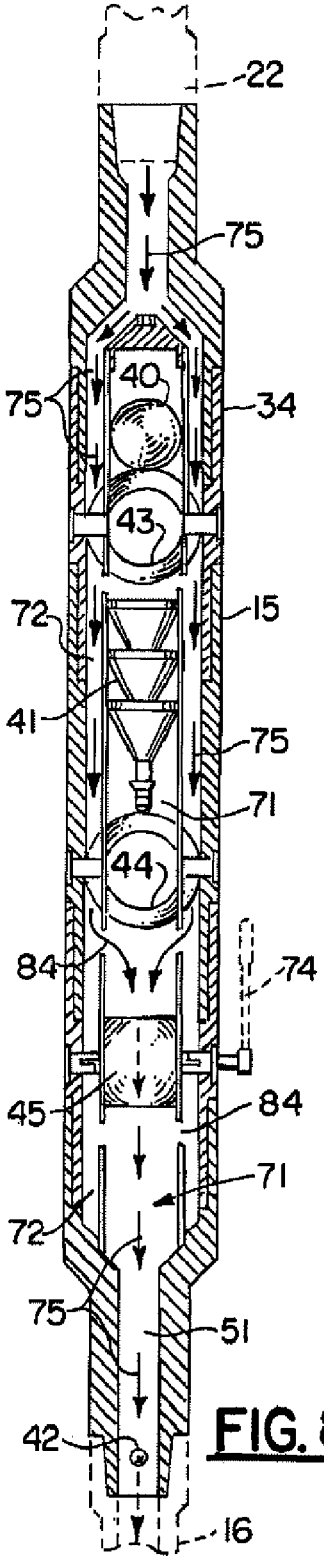
FIG. 8 is a sectional elevation view of the preferred embodiment of the apparatus of the present invention and illustrating a method step of the present invention.

In FIGS. 2-3, 5 and 7-8, a tool 74 has been used to rotate valving member 45 to an open position that aligns its channel 53 with central flow channel 71 enabling smaller diameter ball 42 to fall downwardly via central flow channel 71 (FIG. 8). In FIG. 5, outer flow channel 72 has been closed by fins 73 that have now rotated about 90 degrees from the open position of FIG. 4 to the closed position. Fins 73 close channel 72 in FIG. 5. It should be understood that tool 74 can also be used to rotate valving member 44 from an open position of FIG. 1B to a closed position such as is shown in FIG. 5 when it is desired that dart 41 should drop. Similarly, tool 74 can be used to rotate upper valving member 43 from the closed position of FIG. 1A to an open position such as is shown in FIG. 5 when it is desired to drop larger diameter ball 40.

FIGS. 7-16 illustrate further the method and apparatus of the present invention. In FIG. 8, lower or third valving member 45 has been opened as shown in FIG. 5 releasing smaller diameter ball 42. In FIG. 8, smaller diameter ball 42 is shown dropping wherein it is in phantom lines, its path indicated schematically by arrows 75.

FIG. 10 shows a pair of commercially available, known plugs 76, 77. These plugs 76, 77 include upper plug 76 and lower plug 77. Each of the plugs 76, 77 can be provided with a flow passage 79, 81 respectively that enables fluid to circulate through it before ball 42 forms a seal upon the flow passage 81. Smaller diameter ball 42 has seated upon the lower plug 77 in FIG. 10 so that it can now be pumped downwardly, pushing cement 80 ahead of it. In FIG. 11, arrows 78 schematically illustrate the downward movement of lower plug 77 when urged downwardly by a pumped substance such as a pumpable cement or like material 80. Each of the plugs 76, 77 can be provided with a flow passage 79, 81 respectively that enables fluid to circulate through it before ball 42 forms a seal upon the flow passage 81 (see FIG. 11). When plug 77 reaches float valve 28, pressure can be increased to push ball 42 through plug 77, float valve 28 and casing shoe 27 so that the cement flows (see arrows 100, FIG. 11) into the space 101 between formation 26 and casing 32.

Figure 12:
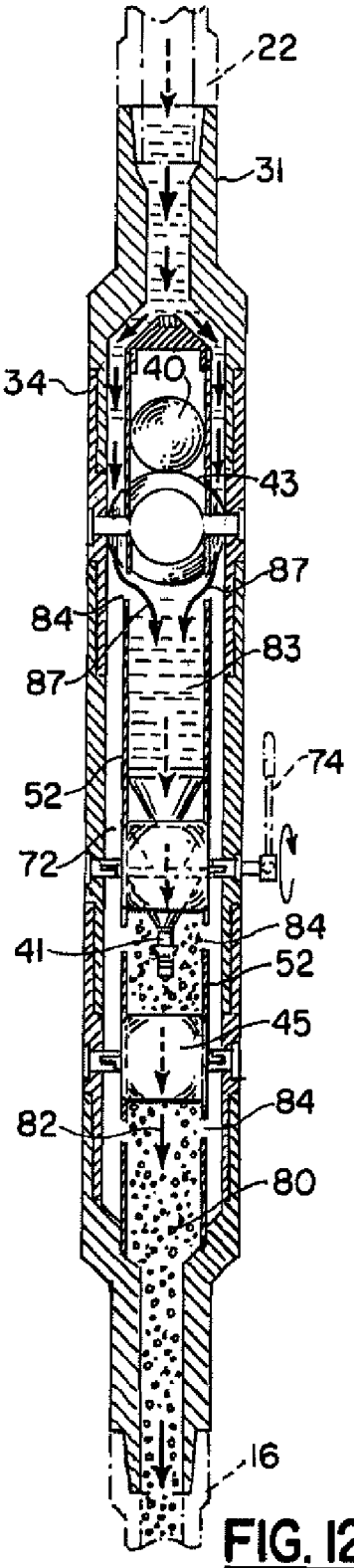
FIG. 12 is a sectional elevation view illustrating part of the method of the present invention.
Figure 13:
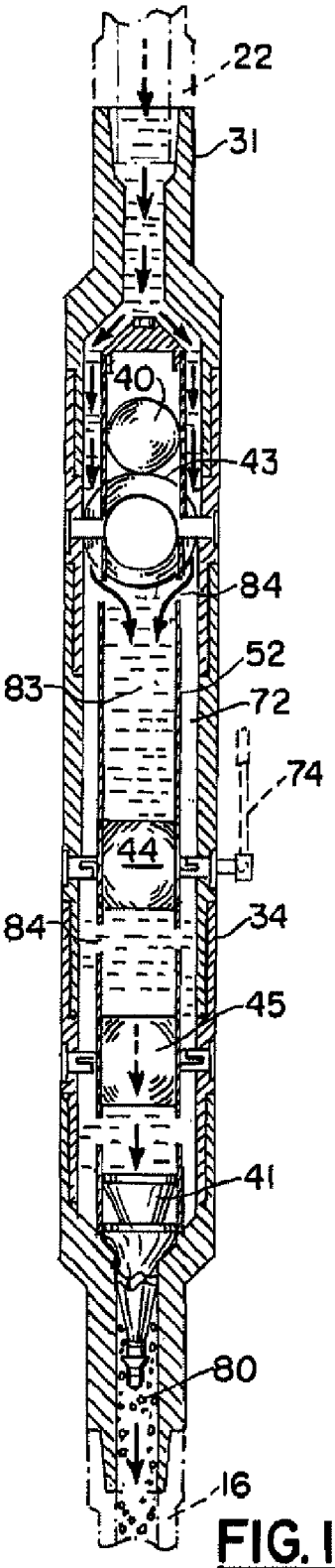
FIG. 13 is a sectional elevation view illustrating part of the method of the present invention.

In FIG. 12, second valving member 44 is opened releasing dart 41. Dart 41 can be used to push the cement 80 downwardly in the direction of arrows 82. A completion fluid or other fluid 83 can be used to pump dart 41 downwardly, pushing cement 80 ahead of it. Once valves 44 and 45 are opened, fluid 83 can flow through openings 84 provided in sleeves 52 below the opened valving member (see FIG. 7) as illustrated in FIGS. 7 and 12. Thus, as each valving member 43 or 44 or 45 is opened, fluid moves through the openings 84 into central flow channel 71.

Figure 14:
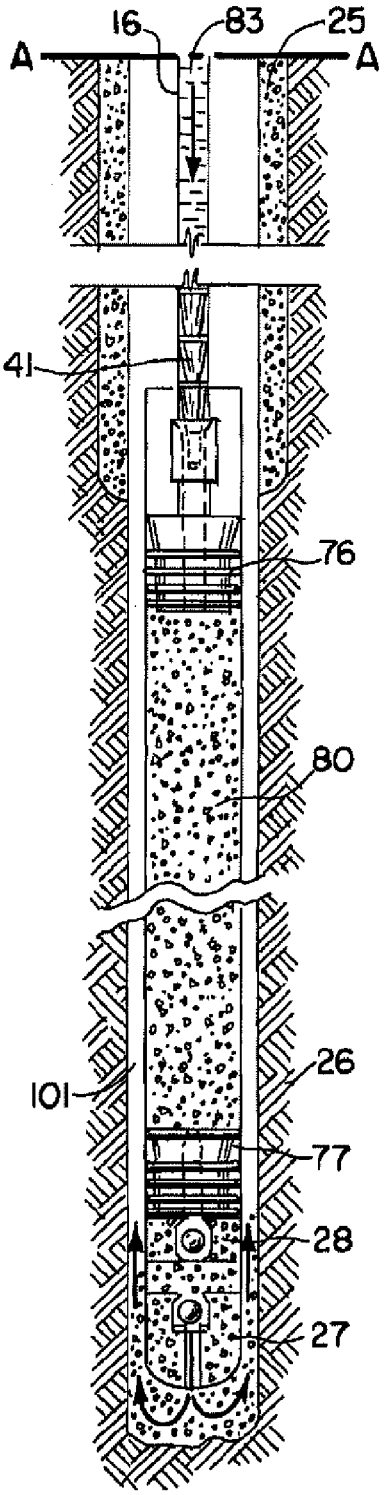
FIG. 14 is a sectional elevation view illustrating part of the method of the present invention and wherein line A-A of FIG. 14 matches line A-A of FIG. 9.
Figure 15:
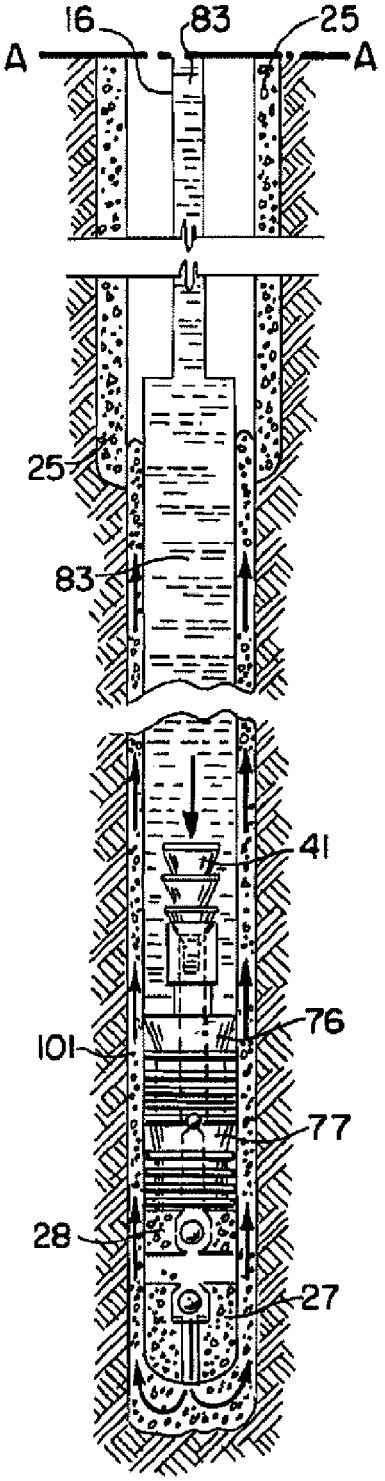
FIG. 15 is a sectional elevation view illustrating part of the method of the present invention and wherein line A-A of FIG. 15 matches line A-A of FIG. 9.
Figure 16:
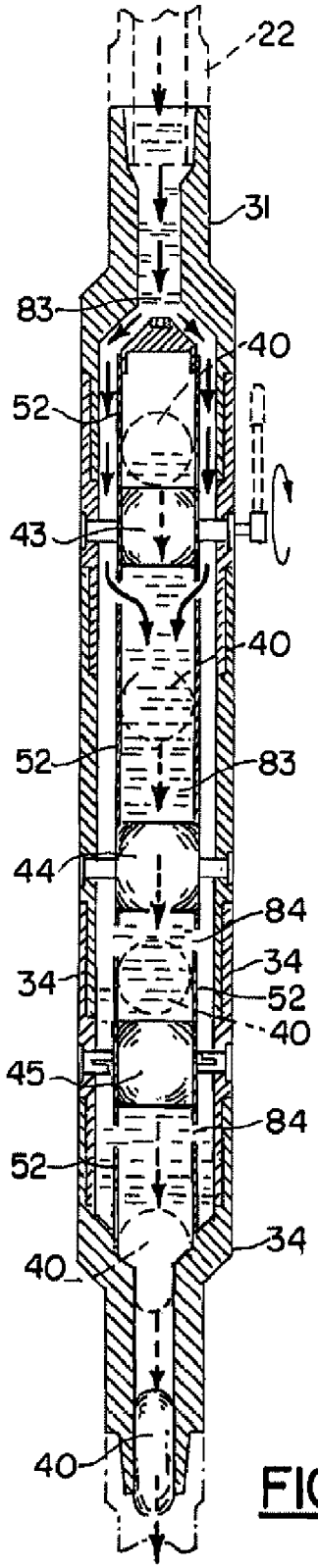
FIG. 16 is a sectional elevation view illustrating part of the method of the present invention.

When valve 44 is opened, dart 41 can be pumped downwardly to engage upper plug 76, registering upon it and closing its flow passage 79, pushing it downwardly as illustrated in FIGS. 14 and 15. Upper plug 79 and dart 41 are pumped downwardly using fluid 83 as illustrated in FIGS. 14 and 15. In FIG. 16, first valving member 43 is opened so that larger diameter ball 40 can move downwardly, pushing any remaining cement 80 downwardly.

The ball 40 can be deformable, so that it can enter the smaller diameter section 86 at the lower end portion of tool body 34. During this process, cement or like mixture 80 is forced downwardly through float collar 28 and casing shoe 27 into the space that is in between production casing 32 and formation 26. This operation helps stabilize production casing 32 and prevents erosion of the surrounding formation 26 during drilling operations.

During drilling operations, a drill bit is lowered on a drill string using derrick 12, wherein the drill bit simply drills through the production casing 32 as it expands the well downwardly in search of oil.

Figure 20:
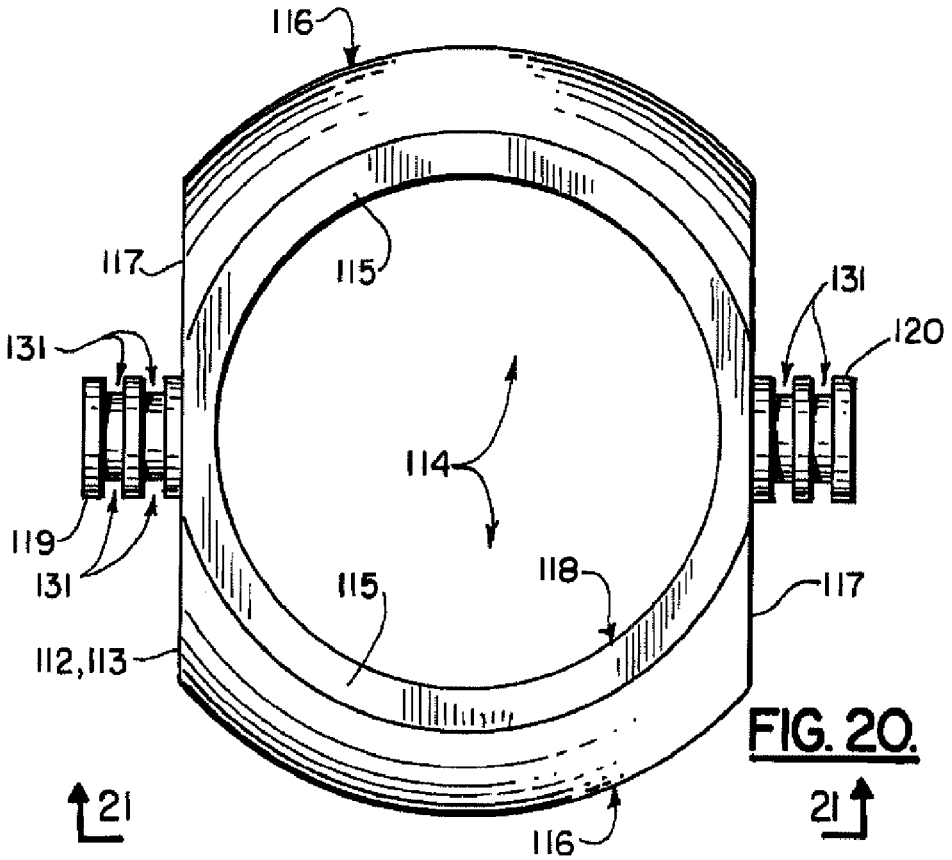
FIG. 20 is a partial view of the preferred embodiment of the apparatus of the present invention and showing a ball valving member.
Figure 21:
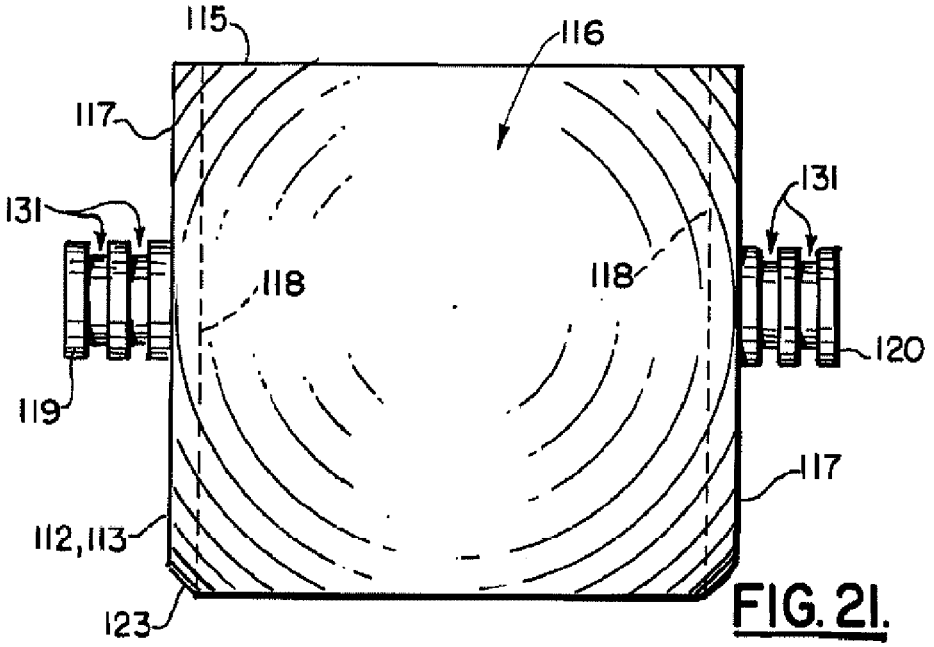
FIG. 21 is a partial side view of the preferred embodiment of the apparatus of the present invention and showing an alternate construction for the ball valving member.
Figure 22:
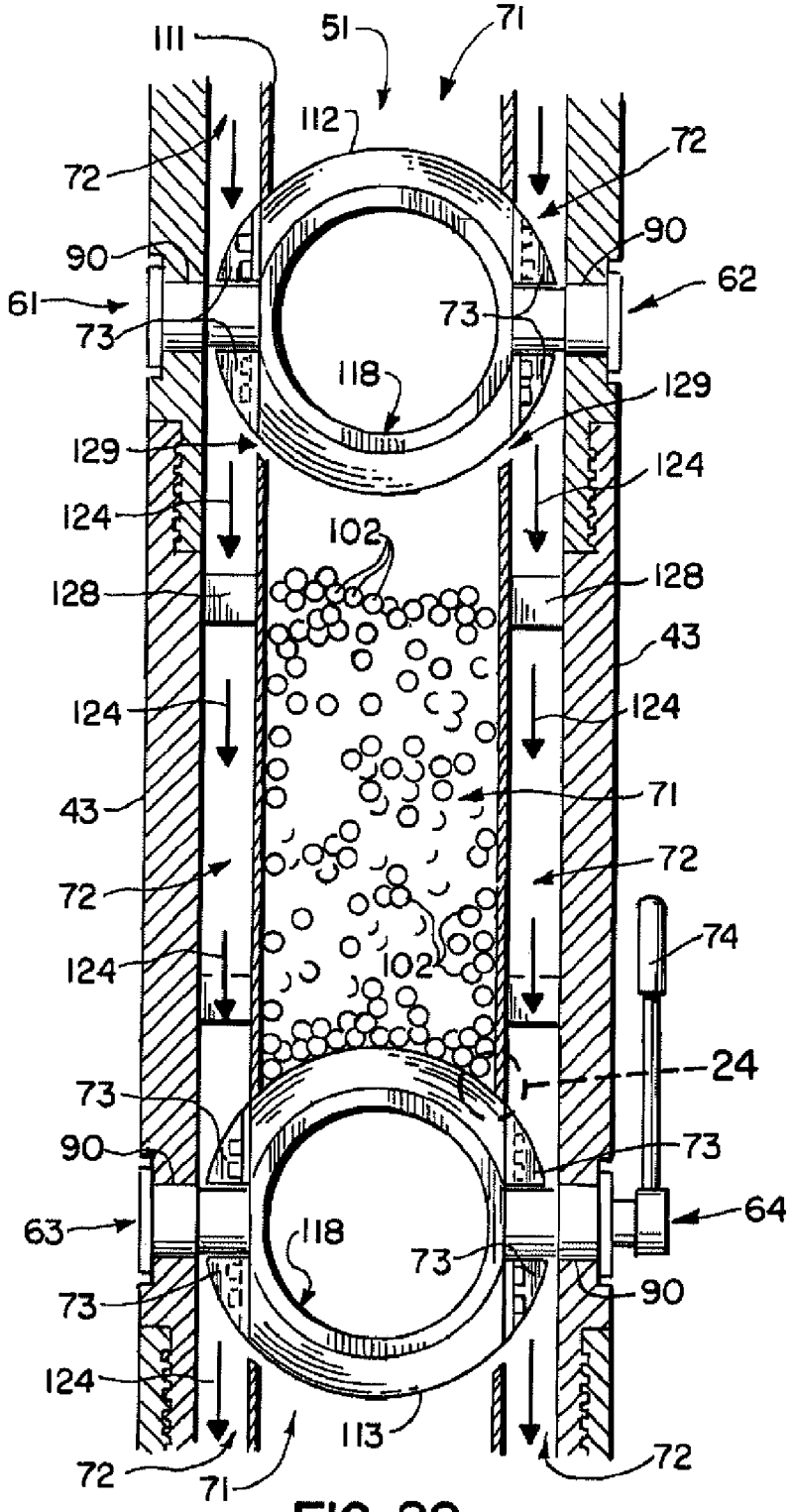
FIG. 22 is a sectional view of the preferred embodiment of the apparatus of the present invention showing an alternate sleeve arrangement.
Figure 23:
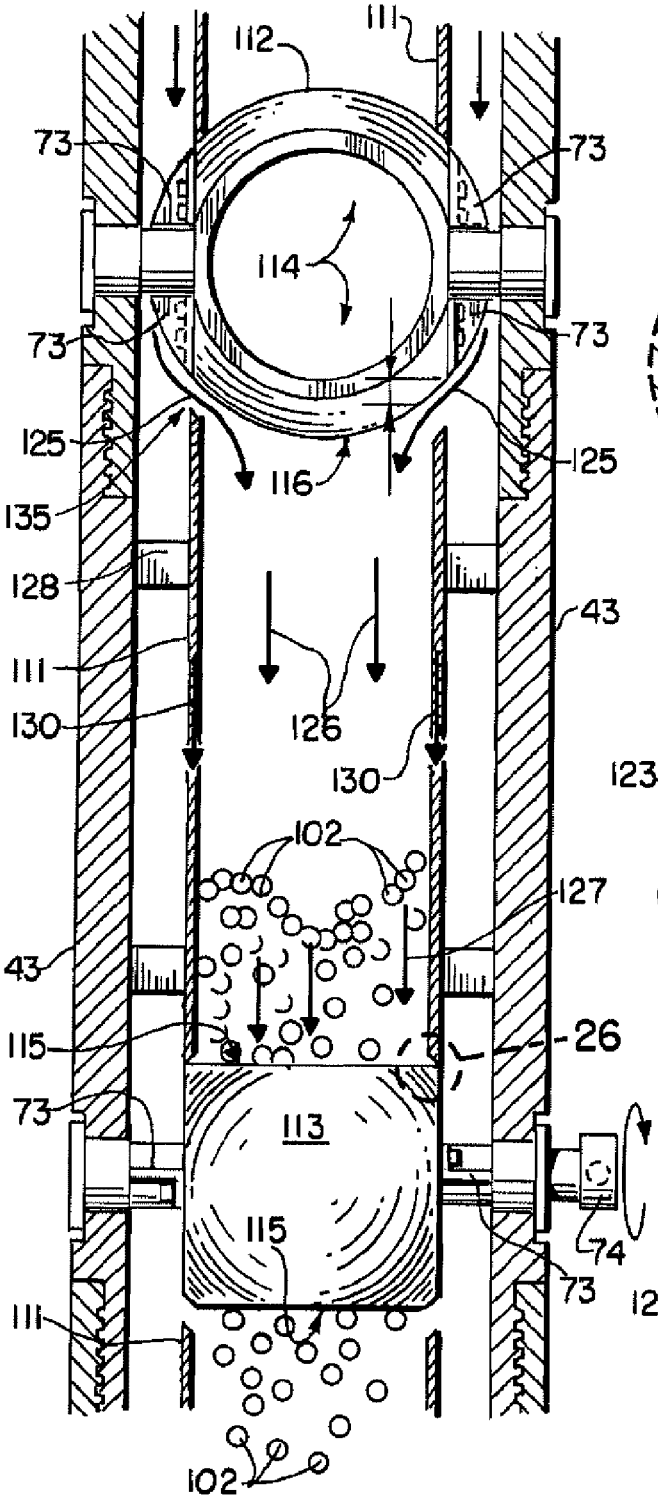
FIG. 23 is a sectional view of the preferred embodiment of the apparatus of the present invention showing an alternate sleeve arrangement.
Figure 24:
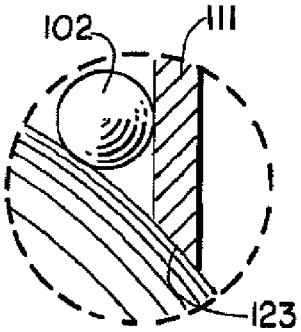
FIG. 24 is a fragmentary view of the preferred embodiment of the apparatus of the present invention.
Figure 25:
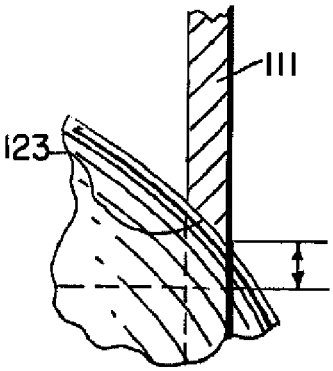
FIG. 25 is a fragmentary view of the preferred embodiment of the apparatus of the present invention.
Figure 26:
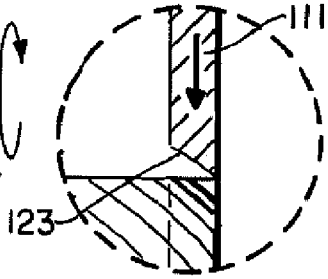
FIG. 26 is a fragmentary view of the preferred embodiment of the apparatus of the present invention.

FIGS. 18-26 show an alternate embodiment of the apparatus of the present invention, designated generally by the numeral 110 in FIGS. 22-23. In FIGS. 18-26, the flow openings 84 in sleeves 52 of ball/plug dropping head 110 of FIGS. 1-17 have been eliminated. Instead, sliding sleeves 111 are provided that move up or down responsive to movement of a selected valving member 112, 113. It should be understood that the same tool body 34 can be used with the embodiment of FIGS. 18-26, connected in the same manner shown in FIGS. 1-17 to tubular member 22 and string 16. In FIGS. 18-26, valving members 112, 113 replace the valving members 43, 44, 45 of FIGS. 1-17. In FIGS. 18-26, sleeves 111 replace sleeves 52. While two valving members 112, 113 are shown in FIGS. 22, 23, it should be understood that three such valving members (and a corresponding sleeve 111) could be employed, each valving member 112, 113 replacing a valving member 43, 44, 45 of FIGS. 1-17.

Figure 19:
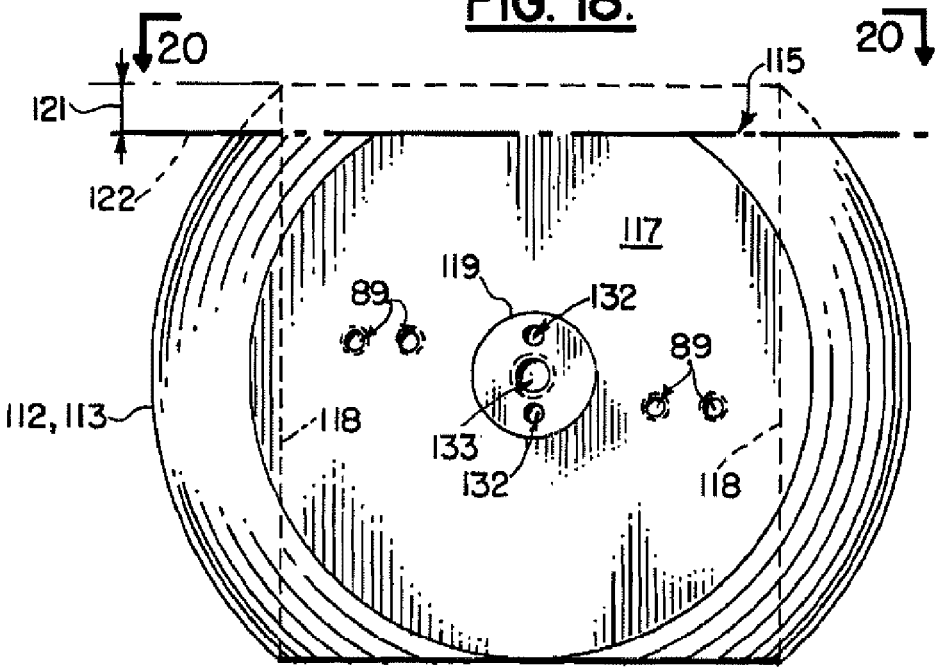
FIG. 19 is a partial side view of the preferred embodiment of the apparatus of the present invention and showing an alternate construction for the ball valving member.

In FIGS. 18-26, tool body 34 has upper and lower end portions 31, 33. As with the preferred embodiment of FIGS. 1-17, a flow bore 51 provides a central flow channel 71 and outer flow channel 72. Each valving member 112, 113 provides a valve opening 114. Each valving member 112, 113 provides a flat surface 115 (see FIG. 20). Each valving member 112, 113 provides a pair of opposed curved surfaces 116 as shown in FIG. 20 and a pair of opposed flat surfaces 117, each having a stem 119 or 120.

An internal, generally cylindrically shaped surface 118 surrounds valve opening 114 as shown in FIG. 20. Each valving member 112, 113 provides opposed stems 119, 120. Each valving member 112, 113 rotates between opened and closed positions by rotating upon stems 119, 120. Each of the stems 119, 120 is mounted in a stem opening 90 of tool body 34 at positions 61, 62 and 63, 64 as shown in FIG. 22.

In FIG. 19, valving member 122, 123 is similar in configuration and in sizing to the valving members 43, 44, 45 of the preferred embodiment of FIGS. 1-17, with the exception of a portion that has been removed which is indicated in phantom lines in FIG. 19. The milled or cut-away portion of the valving member 112, 113 is indicated schematically by the arrow 121. Reference line 122 in FIG. 19 indicates the final shape of valving member 112, 113 after having been milled or cut. In FIGS. 20 and 21, a beveled edge at 123 is provided for each valving member 112, 113.

When a valving member 112, 113 is in the closed position of FIG. 22, flow arrows 124 indicate the flow of fluid through the tool body 34 bore 51 and more particularly in the outer channel 72 as indicated in FIG. 22.

In FIG. 23, the lower valving member 113 has been rotated to an open position as indicated schematically by the arrow 134, having been rotated with tool 74. In this position, fins 73 now block the flow of fluid in outer channel 72. Flat surface 115 now faces upwardly. In this position, the cut-away portion of valving member 113 that is indicated schematically by the arrow 121 in FIG. 19 now faces up. Sliding sleeve 111 drops downwardly as indicated schematically by arrows 130 when a valving member 112 or 113 is rotated to an open position (see valving member 113 in FIG. 23). In FIG. 22, a gap 129 was present in between upper valve 112 and sleeve 111 that is below the valve 112. The sleeve 111 that is in between the valves 112,113 is shown in FIG. 22 as being filled with very small diameter balls or "frac-balls" 102.

When valving member 113 is rotated to the open position of FIG. 23, the gap is now a larger gap, indicated as 135. Gap 135 (when compared to smaller gap 129) has become enlarged an amount equal to the distance 121 illustrated by arrow 121 in FIG. 19. The frac-balls 102 now drop through valving member 113 as illustrated by arrows 127 in FIG. 23. Arrows 125, 126 in FIG. 23 illustrate the flow of fluid downwardly through gap 135 and in central channel 71.

A sleeve 111 above a valving member 112 or 113 thus move up and down responsive to a rotation of that valving member 112 or 113. Spacers 28 can be employed that extend from each sleeve 111 radially to slidably engage tool body 34. In FIGS. 20 and 21, each stem 119, 120 can be provided with one or more annular grooves 131 that are receptive of o-rings 60 or other sealing material. As with the preferred embodiment of FIGS. 1-17, openings 132 in each stem 119, 120 are receptive of pins 99. Likewise, each stem 119, 120 provides internally threaded openings 133. Thus, the same connection for attaching a valving member 112, 113 to tool body 34 can be the one shown in FIGS. 1-17.

FIGS. 27A-33 show another embodiment of the apparatus of the present invention wherein the tool body 136 provides an upper sleeve 140 that differs in construction from the sleeve of the embodiments of FIGS. 1-26. Further, the tool body 136 of FIGS. 27A-33 provides an indicator 147 that indicates to a user whether or not a ball or dart 145, 146 has in fact been discharged from the tool body 136. Further, the embodiment of FIGS. 27A-33 provides specially configured inserts or sleeves 160, 163 that are positioned below the lower valve 113, this additional sleeve or insert 160 is configured to prevent a build-up of material within the flow bore 51 below lower valving member 113.

In FIGS. 27A-33, tool body 136 provides upper end portion 137 and lower end portion 138. As with the embodiments of FIGS. 1-26, the tool body 136 can be formed similarly to the tool body 34, having multiple sections 35, 36, 37, 38 and 139. The section 139 is similar to the section 39 of FIGS. 1-26. However, the section 139 is configured to accept sleeve or insert 160 and sleeve or insert 163.

Sleeve 140 is similar to the sleeves 111 of FIGS. 18-26. The sleeve 140 provides a cap 141 that can be connected to the sleeve 140 using threaded connection 142. Cap 141 provides one or more longitudinally extending and circumferentially spaced apart openings 143. The cap 141 can also provide a tool receptive socket 144 that enables rotation of cap 141, relative to sleeve 140, using a tool (e.g. allen wrench) during assembly of cap 141 to sleeve 140.

In FIGS. 27B, 28-33 indicator 147 is shown. The indicator 147 indicates to a user whether or not a dart 145, 146 has passed the indicator 147, thus indicating a discharge of the dart 145, 146 from the tool body 136.

Figure 27A:
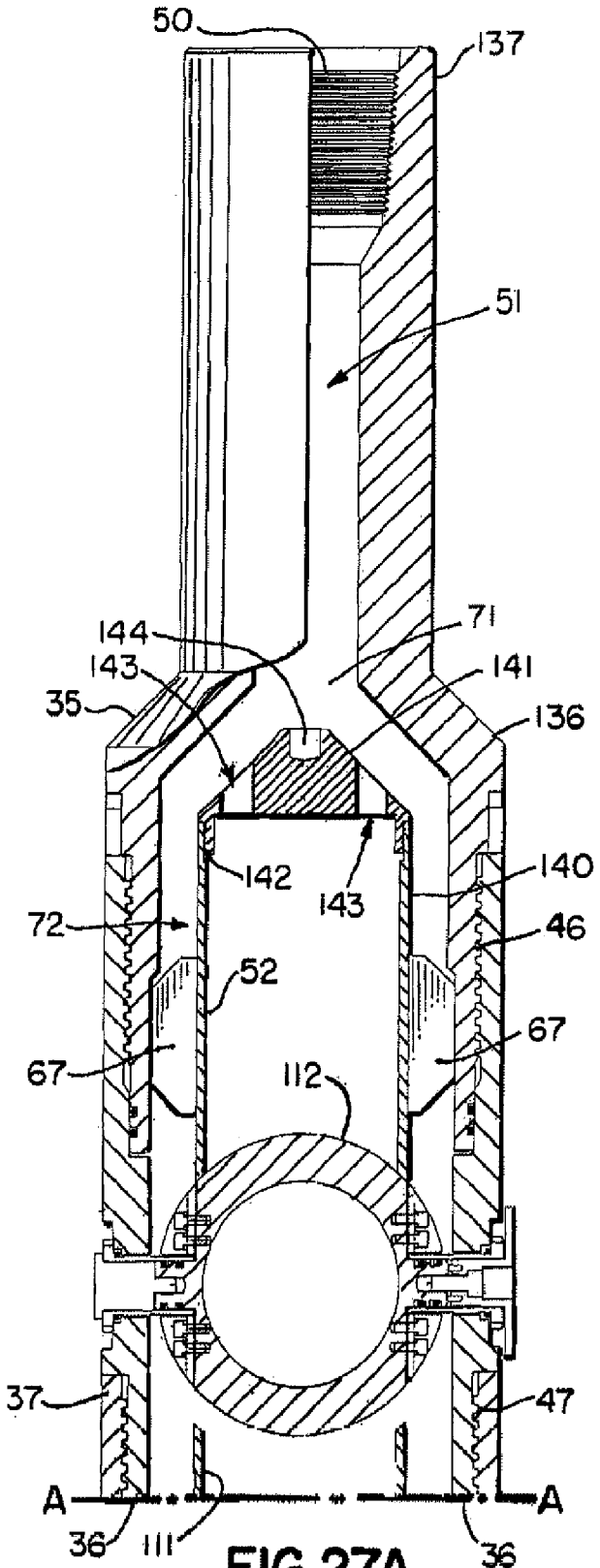
FIGS. 27A, 27B, 27C are sectional elevation views of an alternate embodiment of the apparatus of the present invention wherein the lines A-A are match lines and the lines B-B are match lines.
Figure 27B:
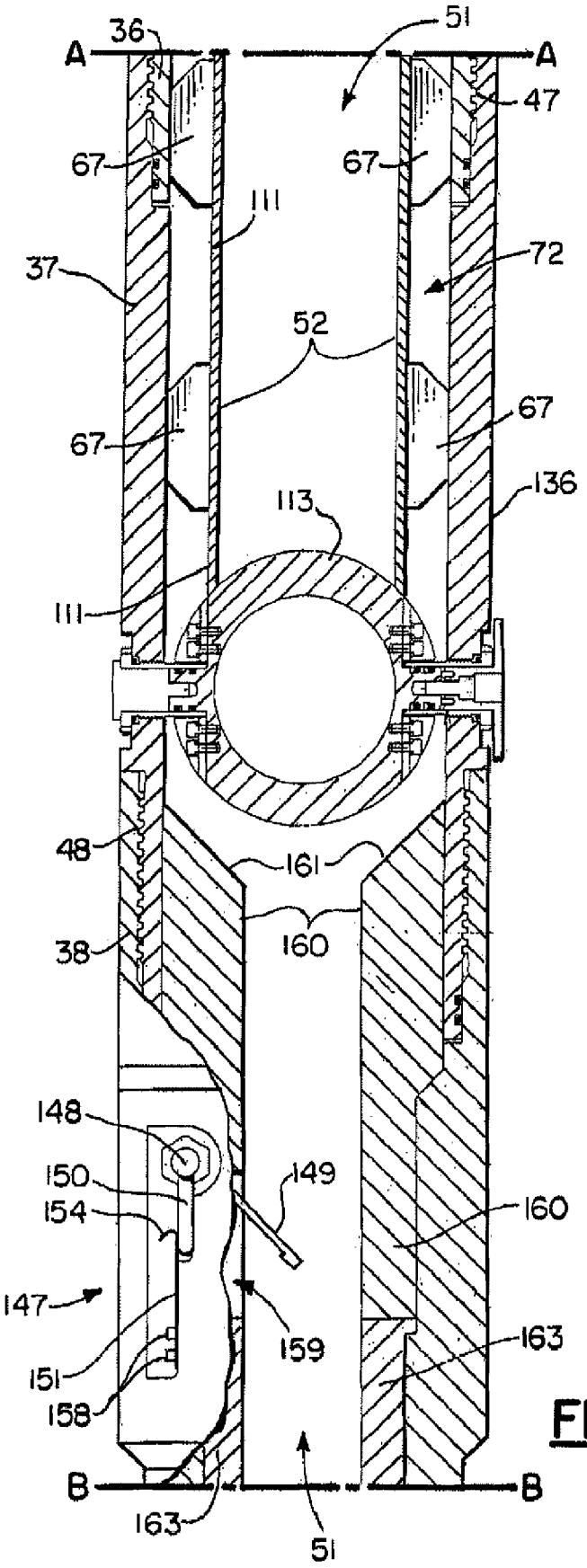
Figure 28:
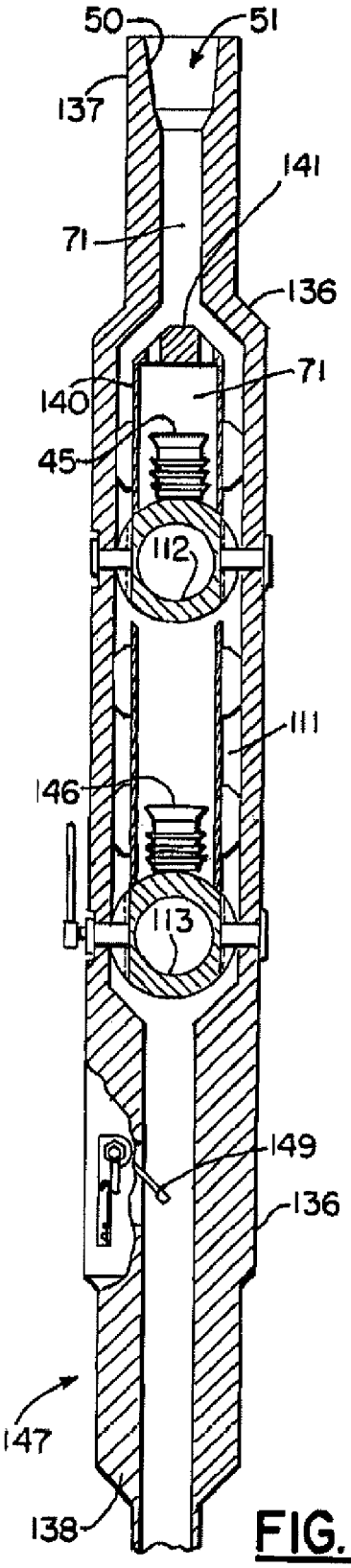
FIG. 28 is a sectional elevation view of the alternate embodiment of the apparatus of the present invention showing both valves in a closed position.
Figure 29:
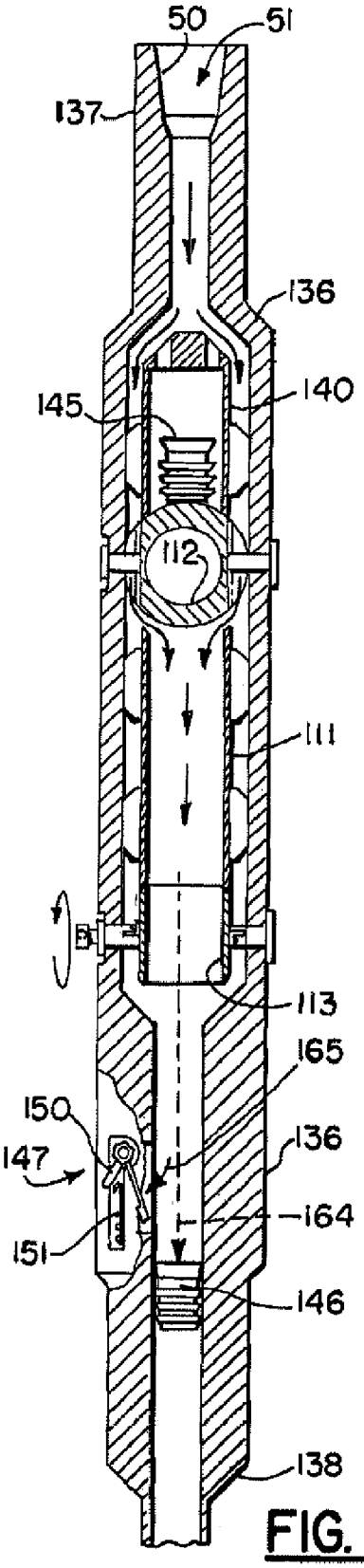
FIG. 29 is a sectional elevation view of the alternate embodiment of the apparatus of the present invention showing the upper valve in a closed position and the lower valve in an open position.

In FIGS. 27B and 28-33, indicator 147 provides a shaft 148 that extends horizontally relative to flow bore 51 of tool body 136. Lever arm 149 moves between an extended position as shown in FIG. 27B and a collapsed position as shown in FIG. 29. The lever arm 149 is initially set in the extended position of FIG. 27B by placing pin 150 behind spring 151 upper end 154 as shown in FIG. 27B. Spring 151 thus holds the pin 150 in a generally vertical position by rotating shaft 148 so that arm 149 extends into flow bore 51.

In FIG. 28, upper valve 112 is shown supporting a first dart 145. Lower valve 113 is shown supporting a second dart 146. Operation is the same as was described with respect to FIGS. 1-26. Lower valve 113, is rotated to an open position as shown in FIG. 29 by rotating the valve 113 through about ninety degrees. Dart 146 then drops as indicated by arrow 164 in FIG. 29. As the dart 146 travels downwardly, leaving valve 113 and moving toward lower end portion 138 of tool body 136, the dart 146 engages lever arm 149. The dart 146 continues to move downwardly, pushing the arm 149 to the retracted position of FIG. 29 as illustrated by arrow 165 in FIG. 29. In this position, the pin 150 deflects spring 151 until pin 150 assumes the position shown in phantom lines in FIG. 32.

Figure 30:
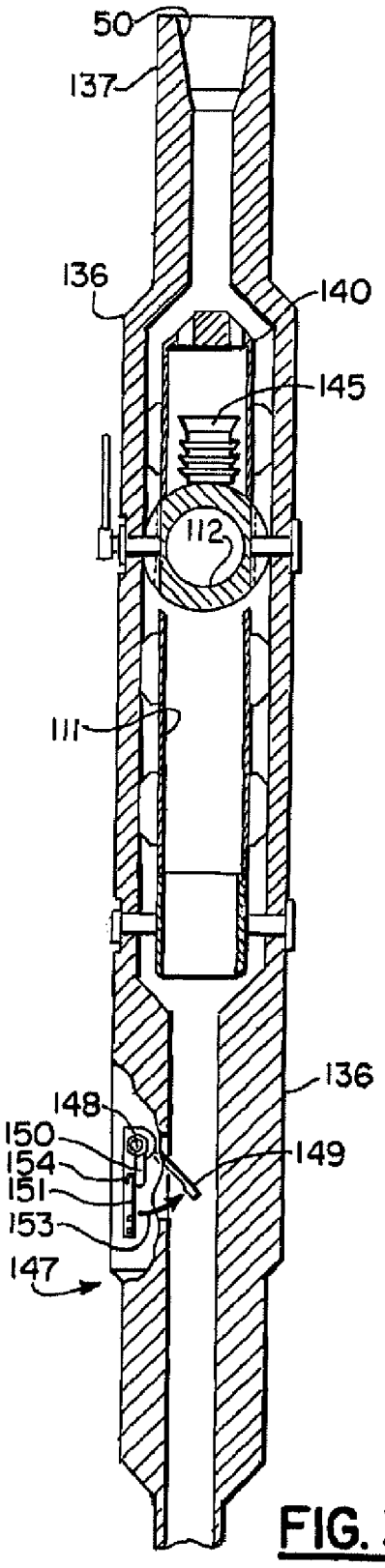
FIG. 30 is a sectional elevation view of the alternate embodiment of the apparatus of the present invention.
Figure 31:
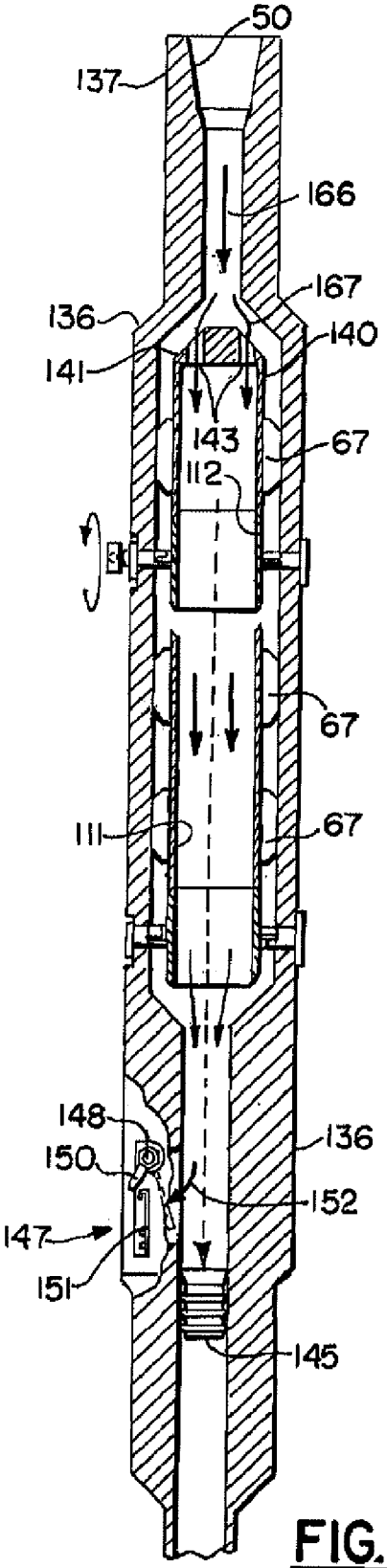
FIG. 31 is a sectional elevation view of the alternate embodiment of the apparatus of the present invention showing both valves in an open position.
Figure 32:
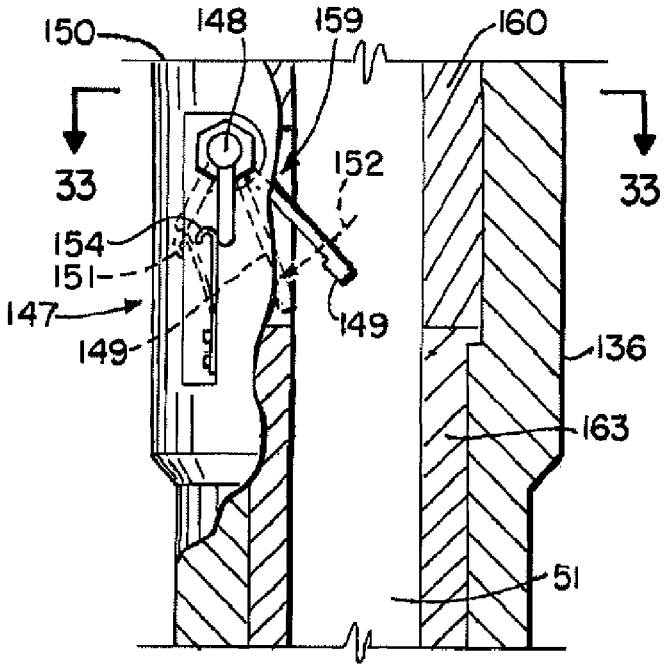
FIG. 32 is a fragmentary sectional elevation view of the preferred embodiment of the apparatus of the present invention.

The spring 151 upper end portion 154 prevents the pin 150 from returning to the position of FIG. 28, as the pin is now being held in the position shown in FIG. 29. Arrow 152 in FIG. 32 illustrates the travel of arm 149 from the extended position to the retracted position. An operator can then reset the indicator 147 by rotating the pin 150 to the position shown in FIG. 30 as illustrated by arrow 153 in FIG. 30. This procedure can then be repeated for the upper and second dart 145 as illustrated in FIGS. 30 and 31. In FIG. 31, the upper valve 112 is moved to an open position. A working fluid is pumped into tool body 136 at upper end 137. Flow moves downwardly in the tool body 136 as illustrated by arrows 166. Flow travels through openings 143 in cap 141 as illustrated by arrows 167 in FIG. 31. This downward flow moves the darts 145, 146 downwardly.

Figure 33:
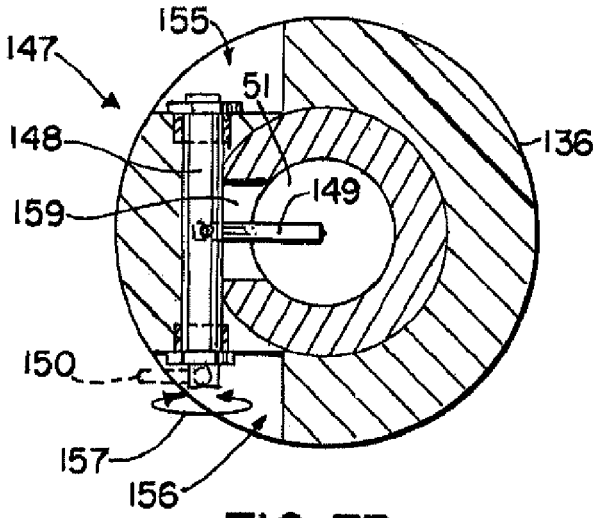
FIG. 33 is a sectional view taken along lines 33-33 of FIG. 32.
Figure 34A:
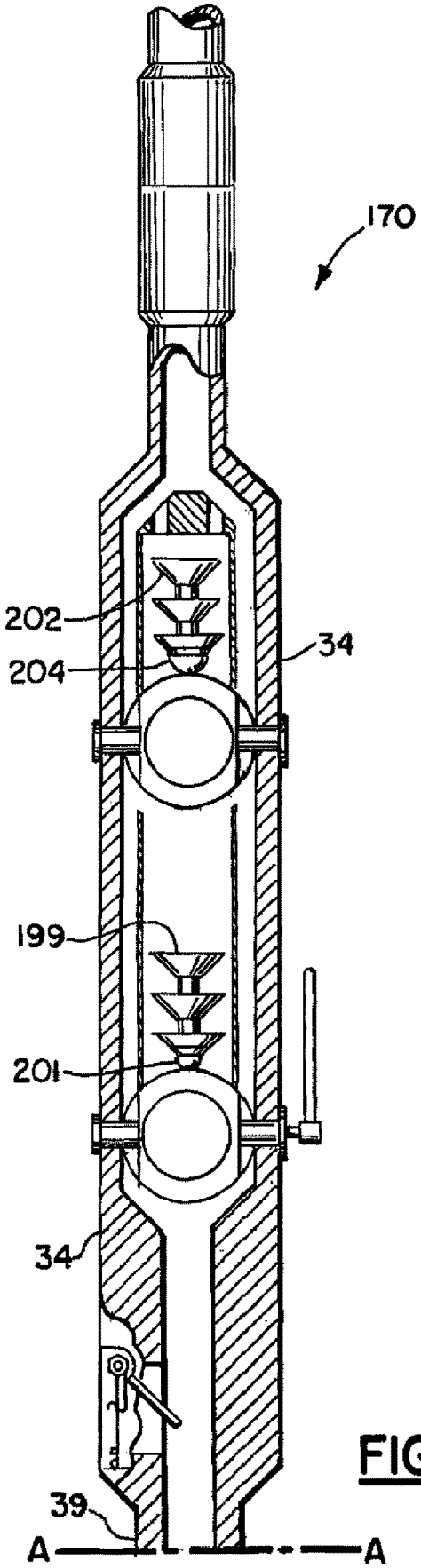
FIGS. 34A-34B are sectional elevation views of another alternate embodiment of the apparatus and method of the present invention showing deployment of an interlocking dart and plug for cementing in larger diameter casing.
Figure 34B:
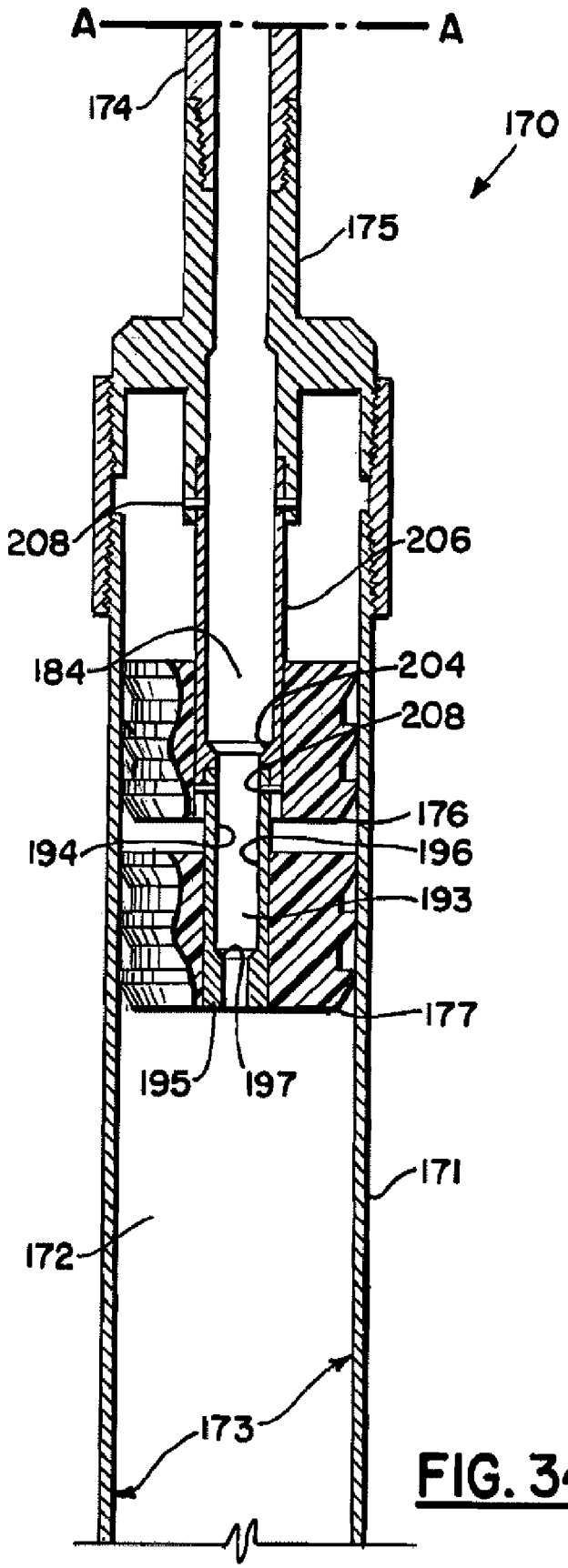

Indicator 147 can be attached to tool body 136 as shown in FIG. 33. A pair of recesses 155, 156 on tool body 136 enable attachment of shaft 148. The shaft 148 can be held in position using fasteners such as bolts, for example. Spring 151 can then be attached to tool body 136 at recess 156 using fasteners 158 such as bolts. Curved arrow 157 in FIG. 33 illustrates rotation of shaft 148 for moving arm 149 and pin 150 between the extended position of FIG. 30 and the retracted position of FIG. 31. Arm 149 extends through slot 159 in the extended position of FIGS. 30, 32, 33.

Figure 27C:
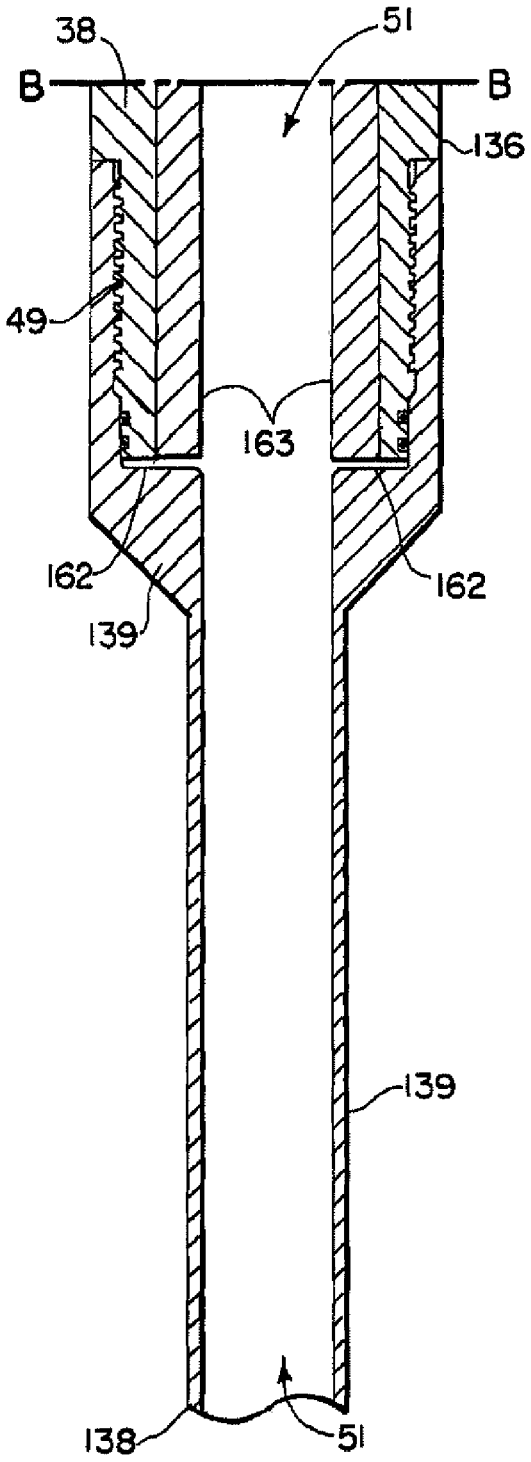

FIGS. 27C and 32 illustrate placement of insert/sleeves 160, 163. The sleeve 160 provides an upper end portion that is conically shaped or tapered. This tapered section 161 is placed just below lower valve 113 and aids in the efficient flow of fluid downwardly in the tool body 136 eliminating unnecessary accumulation of material such as cement. Annular shoulder 162 on tool body 136 enables support of lower insert 163 which is placed below upper insert 160 as shown in FIGS. 27B and 27C.

FIGS. 34A-39 show another alternate embodiment of the apparatus of the present invention, designated generally by the numeral 170. Plug dropping apparatus 170 provides an apparatus that can be used for launching plugs into casing 171. Casing 171 is typically larger diameter and can have a diameter as large as about 20 inches. Examples of casing diameters are: 9⅝ inches, 10¾ inches, 13⅜ inches and 20 inches. The casing 171 shown in FIGS. 34-37 has a casing bore or annulus 172. The casing bore or annulus 172 is defined by casing 171 inside surface 173, which is typically generally cylindrically shaped.

The apparatus 170 of the present invention is designed to launch larger diameter (e.g. between about nine (9) and nineteen (19) inches) plugs such as the plugs 176, 177 shown into a section of casing 171 having a casing bore or annulus 172. This is accomplished using a tool body (e.g. 34) having a pair or more of valving members and a pair of more smaller darts of one or more of the embodiments shown in FIGS. 1-33 in combination with the connectors 174, 175 and casing 171. For example, in FIGS. 34-37, a tool body 34 is shown having a lower section 39 that connects to a smaller connector 174. In order to launch one of the larger diameter plugs 176, 177 that are a larger diameter which is larger than the diameter of tool body 34, a pair of connectors 174,175 are used. These include a smaller connector 174 that is attached to section 39 of tool body 34 and a larger connector 175 that forms a connection between the first, smaller connector 174 and the casing 171. Other connectors can be used as an interface between tool body 34 and casing 171.

Figure 35A:
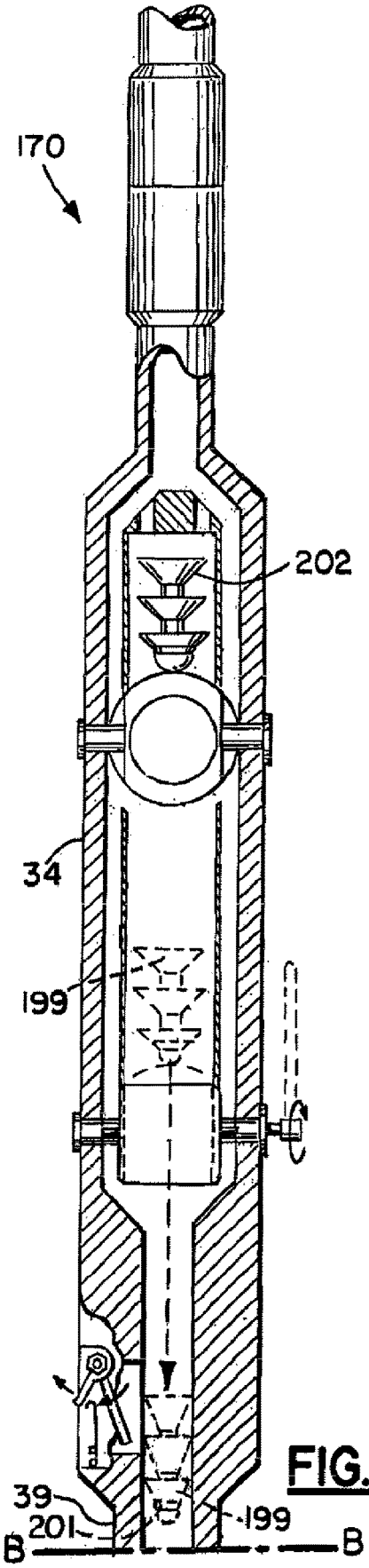
FIGS. 35A-35B are sectional elevation views of another alternate embodiment of the apparatus and method of the present invention showing deployment of an interlocking dart and plug for cementing in larger diameter casing.
Figure 35B:
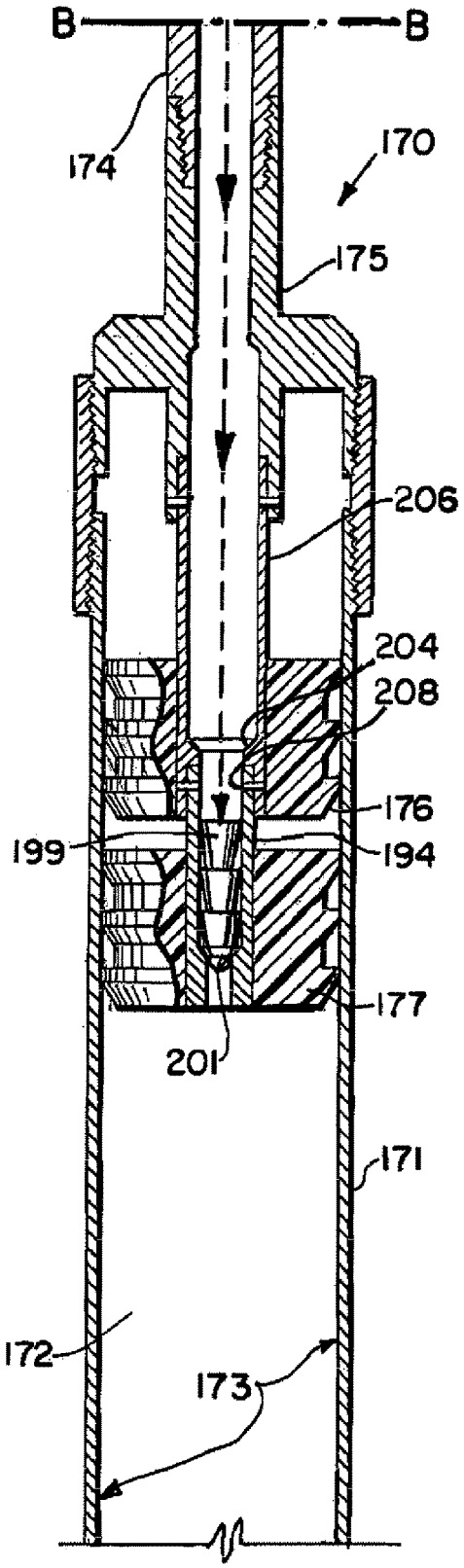
Figure 36A:
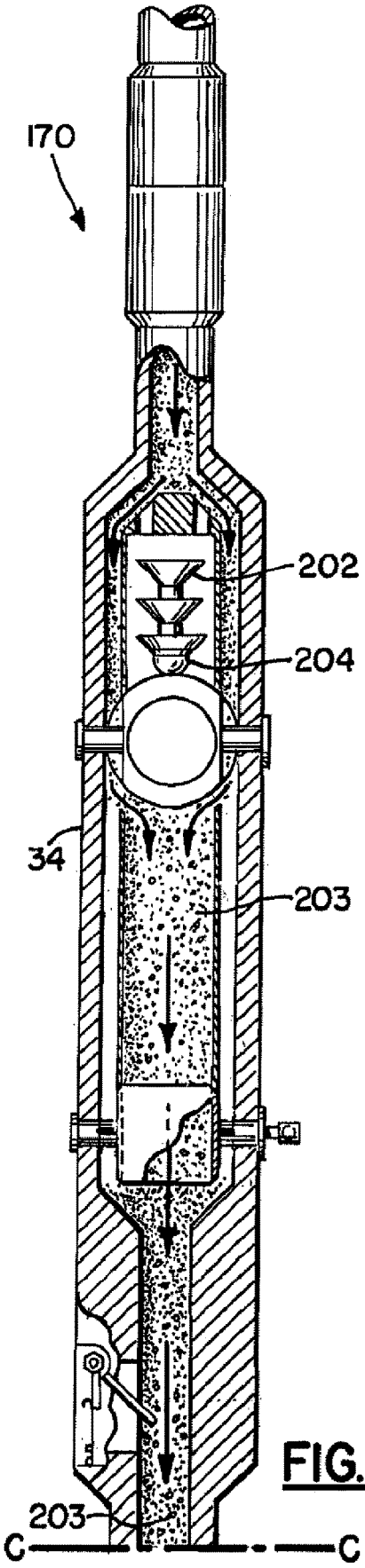
FIGS. 36A-36B are sectional elevation views of another alternate embodiment of the apparatus and method of the present invention showing deployment of an interlocking dart and plug for cementing in larger diameter casing.
Figure 36B:
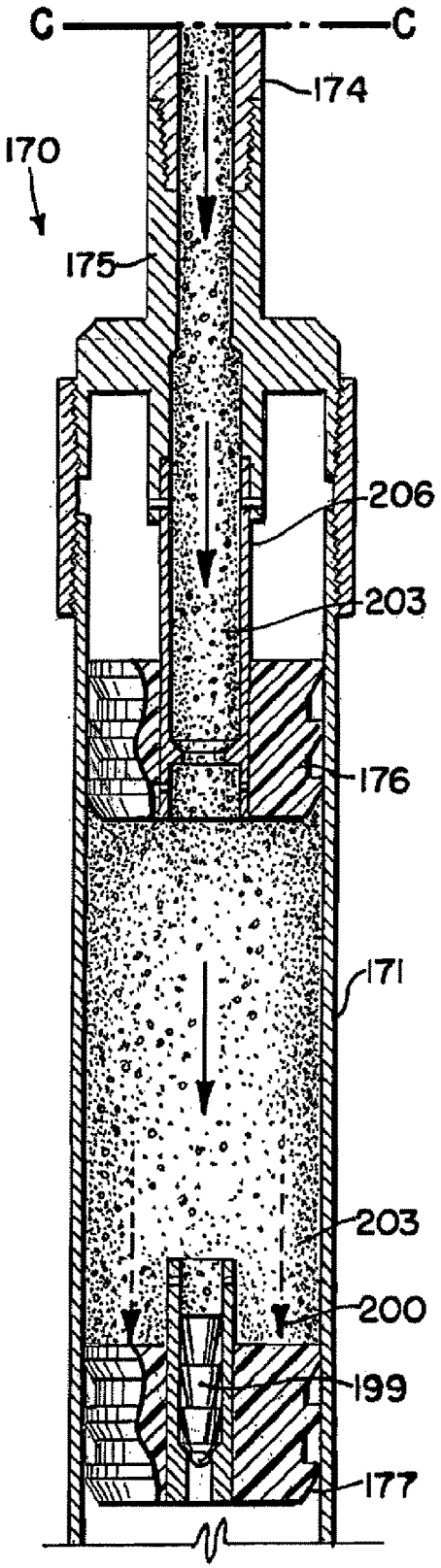
Figure 37:
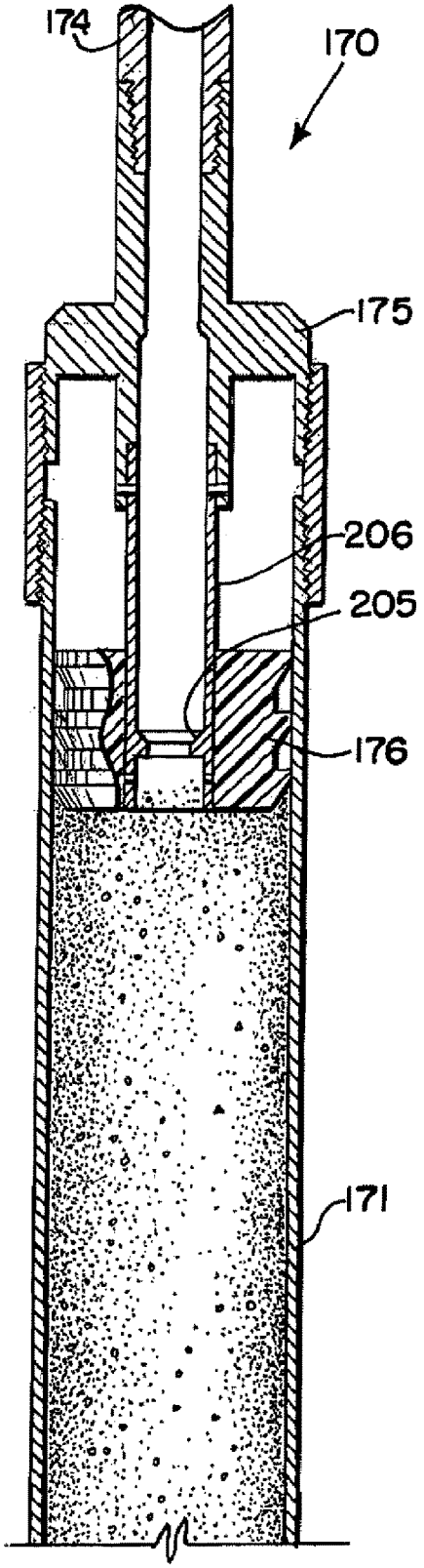
FIG. 37 is a partial, sectional elevation view of the embodiment of FIGS. 34A-36B.

In order to launch the larger diameter plugs 176, 177, a smaller diameter dart 199 is launched from the tool body 34 as shown and described in the embodiments of FIGS. 1-33. The dart 199 is configured to pass through the central channel or bore 184 of an upper or first plug 176 and connect with a sleeve 194 of the second or lower casing plug 177. This connection of the first dart 199 with the second or lower casing plug 177 can be seen in FIG. 35B. In FIG. 36B, arrow 200 illustrates a downward movement of the combination of second casing plug 177 and dart 199 followed by pumped cement 203.

In FIG. 3A, cement 203 is pumped downwardly through tool body 34 to first casing plug 176, passing through channel or bore 184. Pumping of cement through tool body 34 and its valving members is described in more detail with respect to FIGS. 1-33.

The sleeve 194 of the second casing plug 177 provides a beveled annular surface 197 at the sleeve enlarged lower end 195. The sleeve upper end 196 can be generally cylindrically shaped, enabling the dart 199 to easily enter and lodge inside the sleeve 194 and the channel or bore 193 (see FIG. 35B). The dart 199 provides a domed or beveled annular surface 201 that seals and latches upon the beveled annular surface 197 as shown in FIGS. 35B, 36B. In this position, fluid pressure and the downwardly flowing cement 203 can be used to shear pin 208 and force the combination of dart 199 and plug 177 down into the casing 171 bore or annulus 172 (see FIG. 36B).

Once the combination of dart 199 and second casing plug 177 move downwardly as indicated by arrow 200 in FIG. 36B, cement can follow. A volume of cement 203 or cement mixture 203 can be a part of the driving force that moves the plug and dart combination 177, 179 downwardly as shown in FIG. 36B. For cementing operations in a casing 171, the combination of second casing plug 177 and dart 199 move down followed by the volume of cement 203 followed by the combination of casing plug 176 and another dart 202 (see FIGS. 38B, 39). When the selected volume of cement 203 has been transmitted into the casing bore 172 behind second casing plug 177 and dart 199, the dart 202 is launched from tool body 34 and connects with (e.g. seals and latches with) casing plug 177 (see FIGS. 38A, 39). The dart 202 has a lower beveled annular surface or domed or hemispherical surface 204 that registers upon a beveled annular surface 205 of sleeve 206 (see arrow 207 in FIG. 38B). In FIGS. 36B, 37, 38B, and 39 the mass cement or cement mixture 203 has been injected in between the plugs 176, 177.

Figure 38A:
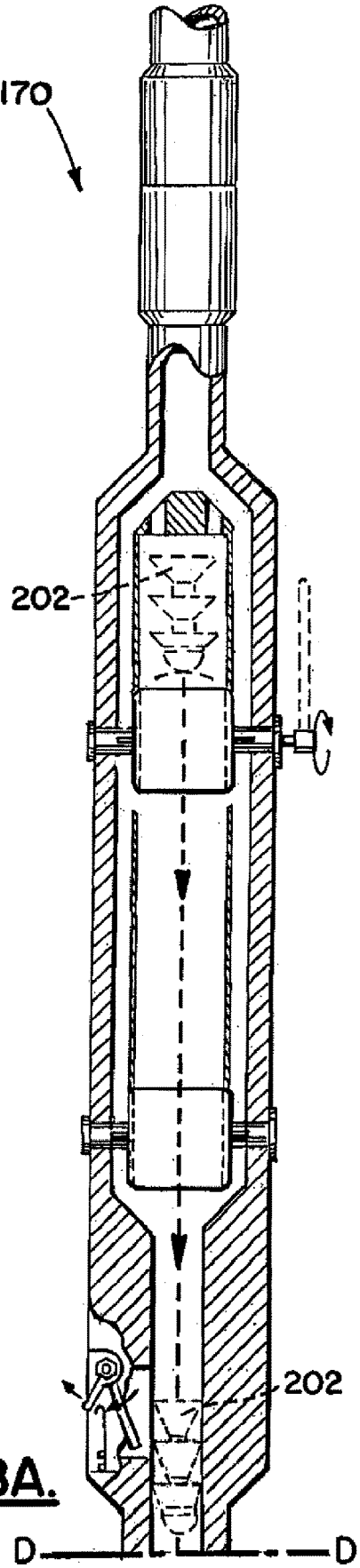
FIGS. 38A-38B are sectional elevation views of another alternate embodiment of the apparatus and method of the present invention showing deployment of an interlocking dart and plug for cementing in larger diameter casing.
Figure 38B:
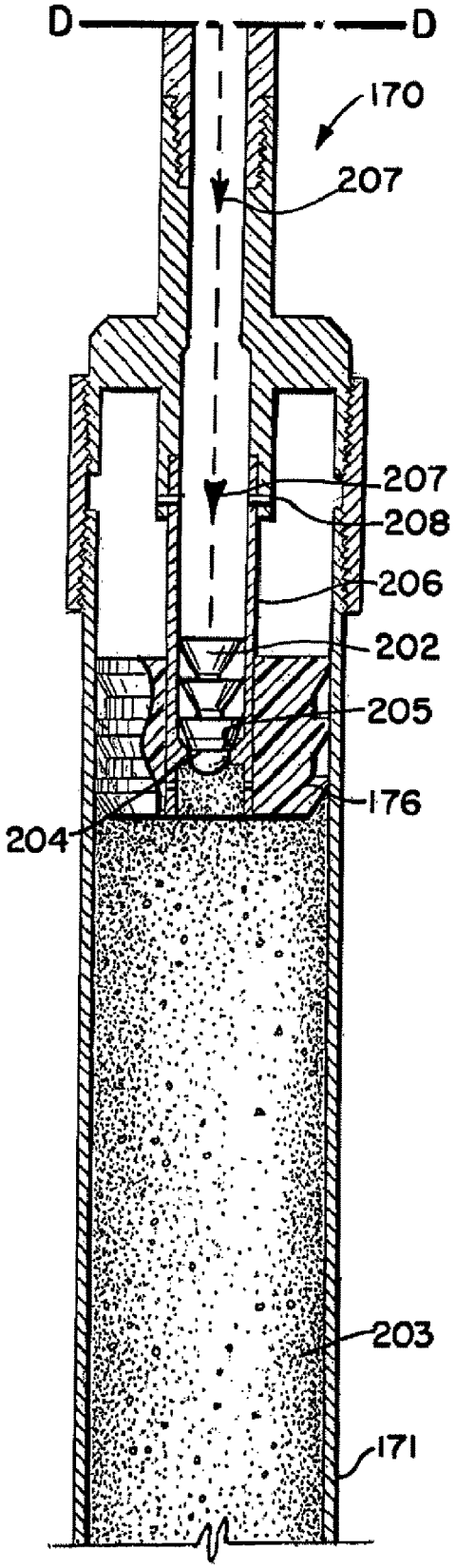
Figure 39:
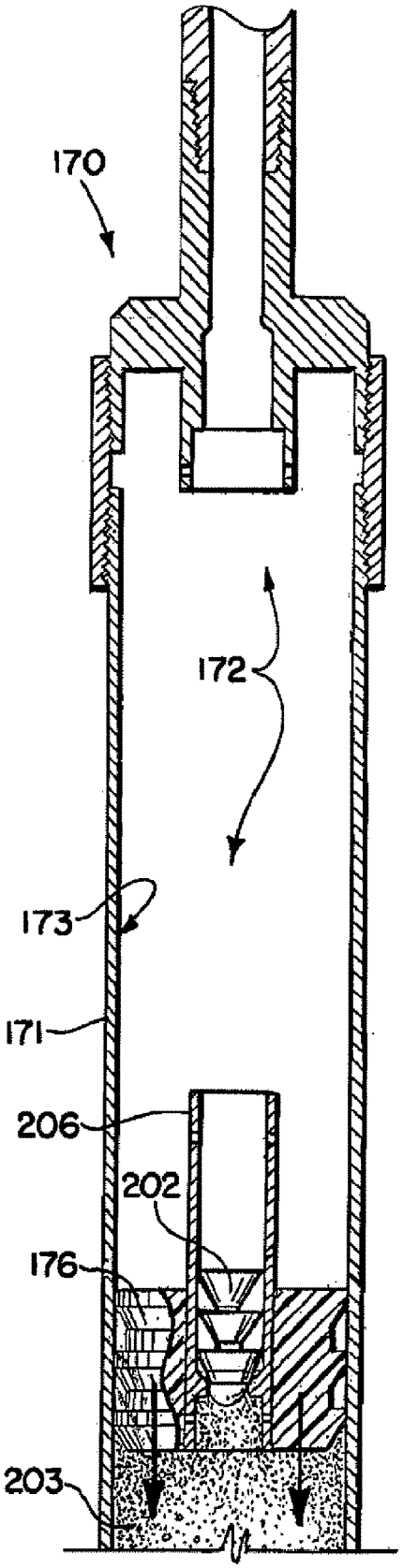
FIG. 39 is a partial, sectional elevation view of the embodiment of FIGS. 34A-36B.

The second dart 202 has a domed or hemispherical or beveled annular surface 204 that seals and latches with beveled annular surface 205 of sleeve 206 of casing plug 176 (see FIG. 38B). Arrow 207 in FIG. 38B represent fluid pressure applied to the assembly of dart 202 and casing plug 176 which can be used to shear pin 208, forcing plug 176 and dart 202 downwardly behind cement 203 (see FIG. 39). Shear pin 208 can be used to hold the sleeves 194, 206 prior to launch. Fluid pressure applied to a dart and plug 199, 177 or 202, 176 can be used to shear pin 208.

The following is a list of parts and materials suitable for use in the present invention.

PARTS LIST

| Part Number | Description |
|---|---|
| 10 | oil well drilling structure |
| 11 | platform |
| 12 | derrick |
| 13 | top drive unit |
| 14 | flow line |
| 15 | ball/plug dropping head |
| 16 | string |
| 17 | sea bed/mud line |
| 18 | body of water |
| 19 | water surface |
| 20 | platform deck |
| 21 | lifting device |

-continued

PARTS LIST

| Part Number | Description |
|---|---|
| 22 | tubular member |
| 23 | well bore |
| 24 | surface casing |
| 25 | cement/concrete |
| 26 | formation |
| 27 | casing shoe |
| 28 | float valve |
| 29 | passageway |
| 30 | passageway |
| 31 | upper end |
| 32 | liner/production casing |
| 33 | lower end portion |
| 34 | tool body |
| 35 | section |
| 36 | section |
| 37 | section |
| 38 | section |
| 39 | section |
| 40 | larger diameter ball |
| 41 | dart |
| 42 | smaller diameter ball |
| 43 | first valving member |
| 44 | second valving member |
| 45 | third valving member |
| 46 | threaded connection |
| 47 | threaded connection |
| 48 | threaded connection |
| 49 | threaded connection |
| 50 | threaded portion |
| 51 | flow bore |
| 52 | sleeve |
| 53 | channel |
| 54 | stem |
| 55 | stem |
| 56 | sleeve |
| 57 | sleeve |
| 58 | plug |
| 59 | plug |
| 60 | o-ring |
| 61 | opening position |
| 62 | opening position |
| 63 | opening position |
| 64 | opening position |
| 65 | opening position |
| 66 | opening position |
| 67 | spacer |
| 68 | outer curved surface |
| 69 | flat surface |
| 70 | flat surface |
| 71 | central flow channel |
| 72 | outer flow channel |
| 73 | fin |
| 74 | tool |
| 75 | arrow |
| 76 | upper plug |
| 77 | lower plug |
| 78 | arrows |
| 79 | flow passage |
| 80 | cement |
| 81 | flow passage |
| 82 | arrow |
| 83 | fluid |
| 84 | opening |
| 85 | opening |
| 86 | smaller diameter section |
| 87 | arrow - fluid flow path |
| 88 | fastener |
| 89 | internally threaded opening |
| 90 | opening |
| 91 | fastener |
| 92 | bushing |
| 93 | external threads |
| 94 | sleeve |
| 95 | passageway/bore |
| 96 | fastener |

-continued

PARTS LIST

| Part Number | Description |
|---|---|
| 97 | internally threaded opening |
| 98 | opening |
| 99 | pin |
| 100 | arrows |
| 101 | space |
| 102 | frac-ball |
| 110 | ball/plug dropping head |
| 111 | sleeve |
| 112 | valving member |
| 113 | valving member |
| 114 | valve opening |
| 115 | flat surface |
| 116 | curved surface |
| 117 | flat surface |
| 118 | internal surface |
| 119 | stem |
| 120 | stem |
| 121 | arrow |
| 122 | reference line |
| 123 | beveled edge |
| 124 | arrow |
| 125 | arrow |
| 126 | arrow |
| 127 | arrow |
| 128 | spacer |
| 129 | smaller gap |
| 130 | arrow sleeve movement |
| 131 | annular groove |
| 132 | opening |
| 133 | internally threaded opening |
| 134 | arrow |
| 135 | larger gap |
| 136 | tool body |
| 137 | upper end portion |
| 138 | lower end portion |
| 139 | section |
| 140 | sleeve |
| 141 | cap |
| 142 | threaded connection |
| 143 | opening |
| 144 | tool receptive socket |
| 145 | dart |
| 146 | dart |
| 147 | indicator |
| 148 | shaft |
| 149 | lever arm |
| 150 | pin |
| 151 | spring |
| 152 | arrow |
| 153 | arrow |
| 154 | spring upper end |
| 155 | recess |
| 156 | recess |
| 157 | curved arrow |
| 158 | fastener |
| 159 | slot |
| 160 | insert/sleeve |
| 161 | conical/tapered section |
| 162 | annular shoulder |
| 163 | insert/sleeve |
| 164 | arrow |
| 165 | arrow |
| 166 | arrow |
| 167 | arrow |
| 170 | plug dropping apparatus |
| 171 | casing |
| 172 | casing bore/annulus |
| 173 | inside surface |
| 174 | smaller connector |
| 175 | larger connector |
| 176 | first casing plug |
| 177 | second casing plug |
| 178 | plug outer surface |
| 179 | annular rib |
| 180 | annular rib |

-continued

PARTS LIST

| Part Number | Description |
|---|---|
| 181 | annular rib |
| 182 | annular groove |
| 183 | annular groove |
| 184 | channel/bore |
| 185 | annular projection |
| 186 | annular shoulder |
| 187 | beveled annular surface |
| 188 | annular rib |
| 189 | annular rib |
| 190 | annular rib |
| 191 | annular groove |
| 192 | annular groove |
| 193 | channel/bore |
| 194 | sleeve |
| 195 | sleeve enlarged lower end |
| 196 | sleeve upper end |
| 197 | beveled annular surface |
| 198 | arrow |
| 199 | dart |
| 200 | arrow |
| 201 | beveled annular surface |
| 202 | dart |
| 203 | cement |
| 204 | domed/hemispherical/beveled lower end |
| 205 | beveled annular surface |
| 206 | sleeve |
| 207 | arrow |
| 208 | shear pin |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A dart and plug dropping head for use in sequentially dropping one or more darts and plugs into a well casing, comprising:

a) a housing having an inlet at its upper end adapted to be fluidly connected in line with the lower end of a top chive, an outlet generally aligned with the inlet;

b) a main flow channel that connects the inlet and the outlet;

c) a plurality of valving members spaced between the inlet and the outlet, each valving member having a flow bore, and being movable between open and closed positions;

d) one or more fluid flow channels that enable fluid to bypass the valving members when a valving member is in the closed position;

e) at least one of the valving members having a cross section that, in the closed position, does not valve fluid flow in the main flow channel;

f) wherein fluid flow in the main channel flows around the valving member when it is in the closed position and through the valving member when it is in the open position;

g) a plurality of darts in the housing, each dart above a valving member, wherein in the open position each valving member flow bore permits a dart to pass therethrough, and circulating fluid to pass downwardly therethrough when neither a dart nor plug is in the valving member flow bore;

h) a connector that connects to the housing to the well casing; and i) one or more casing plugs that are contained in the casing below the connector, wherein each casing plug is receptive of and interlocks with a dart that is dropped from the housing.

2. The dart and plug dropping head of claim 1, wherein the housing has a diameter and each casing plug has a diameter that is longer than the housing diameter.

3. The dart and plug dropping head of claim 1, wherein at least one valving member has a valve opening that enables passage of a dart, and wherein each of the casing plugs has a diameter of between about nine and nineteen inches (9"-19").

4. The dart and plug dropping head of claim 1, wherein at least one valving member in the closed position has a generally cylindrically shaped cross section.

5. The dart and plug dropping head of claim 1, wherein at least one valving member in the closed position has a generally rectangular shaped cross section.

6. The dart and plug dropping head of claim 1, wherein the housing has a working tension of two million pounds.

7. The dart and plug dropping head of claim 1, wherein the housing has an internal working pressure of 15,000 psi.

8. The dart and plug dropping head of claim 1, wherein the housing has a working torque of 50,000 foot pounds.

9. The dart and plug dropping head of claim 8, wherein the housing has a working torque of 50,000 foot pounds in either of two rotational directions.

10. The dart and plug dropping head of claim 1, wherein there are multiple valving members that enable fluid flow around the valving member when the valving member is closed.

11. A dart and plug dropping head for use in sequentially dropping one or more darts and plugs into a well casing, comprising:

a) a housing having an inlet at its upper end adapted to be fluidly connected in line with the lower end of a top drive, an outlet generally aligned with the inlet;

b) a main flow channel that connects the inlet and the outlet, vertically sliding sleeves dividing the main flow channel into an inner channel and an outer channel;

c) a plurality of valving members spaced between the inlet and the outlet, each valving member having a flow bore, and being movable between open and closed positions;

d) the outer channel enabling fluid to bypass a valving member when a valving member is in the closed position;

e) at least one of the valving members having a cross section that, in the open position, does not valve fluid flow in the main flow channel;

f) wherein fluid flow flows around the valving member via the outer channel when it is in the closed position and through the valving member and inner channel when the valving member is in the open position;

g) wherein each valving member is configured to support a dart or plug when closed;

h) a plurality of darts or balls in the housing, wherein in the open position each valving member flow bore permits a dart or ball to pass therethrough, and circulating fluid to pass downwardly therethrough when a dart or ball is not in the valving member flow bore;

i) casing having a casing bore and attached to the housing; and j) one or more casing plugs in the casing bore, each casing plug being connectable to one of the darts or balls when a dart or ball is dropped from the housing into the casing.

12. The dart and plug dropping head of claim 11, wherein the housing has a diameter and each casing plug has a diameter that is larger than the housing diameter.

13. The dart and plug dropping head of claim 11, further comprising an indicator that indicates when a dart or plug has been dropped from the housing, and wherein the indicator includes a shaft and an arm on the shaft.

14. The dart and plug dropping head of claim 13, wherein the indicator has a part that extends into the main flow channel.

15. The dart and plug dropping head of claim 11, wherein each dart has a diameter of between about two and six inches (2"-6").

16. The dart and plug dropping head of claim 11, wherein the inner channel is generally aligned with the flow bore of at least one said valving member.

17. The dart and plug dropping head of claim 11, wherein the housing has a working tension of two million pounds.

18. The dart and plug dropping head of claim 11, wherein the housing has a working torque of 50,000 foot pounds.

19. The dart and plug dropping head of claim 18, wherein the housing has a working torque of 50,000 foot pounds in either of two rotational directions.

20. The dart and plug dropping head of claim 11, wherein there are multiple valving members that enable fluid flow around the valving member when the valving member is closed.

* * * * *